US006059400A

United States Patent [19]

Kimura et al.

[11] Patent Number: 6,059,400

[45] **Date of Patent: *May 9, 2000**

[54] INK JET APPARATUS

[75] Inventors: Makiko Kimura, Sagamihara; Toshio Kashino, Chigasaki; Teruo Arashima, Yokohama; Hiroshi Sugitani, Machida; Yoshifumi Hattori, Yamato; Masami Ikeda, Tokyo; Asao Saito, Yokohama; Kazuaki Masuda, Sagamihara; Akio Saito, Hadano; Tsuyoshi Orikasa, Kasukabe; Takashi Ohba, Zama; Kunihiko Maeoka, Kawasaki; Jun Kawai, Yokohama; Tsutomu Abe, Isehara; Hiroshi Nakagomi, Yamato, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/949,529

[22] Filed: Oct. 14, 1997

Related U.S. Application Data

[62] Division of application No. 08/867,405, Jun. 2, 1997, which is a continuation of application No. 08/466,723, Jun. 6, 1995, abandoned, which is a division of application No. 08/142,056, Oct. 28, 1993, abandoned, which is a division of application No. 07/940,735, Sep. 8, 1992, Pat. No. 5,389,957, which is a continuation of application No. 07/583,336, Sep. 17, 1990, abandoned.

[30] Foreign Application Priority Data

| | | | |
|---|---|---|---|
| Sep. 18, 1989 | [JP] | Japan | 1-241025 |
| Sep. 18, 1989 | [JP] | Japan | 1-241054 |
| Sep. 18, 1989 | [JP] | Japan | 1-241055 |
| Sep. 18, 1989 | [JP] | Japan | 1-241057 |

[51] Int. Cl.[7] ..... B41J 2/05

[52] U.S. Cl. ..... 347/63

[58] Field of Search ..... 347/47, 63, 65, 347/44, 20

[56] References Cited

U.S. PATENT DOCUMENTS

| | | | |
|---|---|---|---|
| 4,007,464 | 2/1977 | Bassous et al. | 347/47 |
| 4,014,029 | 3/1977 | Lane et al. | 347/47 |
| 4,184,169 | 1/1980 | Taylor et al. | 347/48 |
| 4,185,290 | 1/1980 | Hoffman | 347/47 |
| 4,282,533 | 8/1981 | Brooks et al. | 347/47 |
| 4,313,124 | 1/1982 | Hara | 347/57 |
| 4,334,234 | 6/1982 | Shirato et al. | 347/65 |
| 4,345,262 | 8/1982 | Shirato et al. | 347/56 |
| 4,376,945 | 3/1983 | Hara et al. | 347/67 |
| 4,437,105 | 3/1984 | Mrazek et al. | 347/29 |
| 4,459,600 | 7/1984 | Sato et al. | 347/47 |
| 4,463,359 | 7/1984 | Ayata et al. | 347/56 |

(List continued on next page.)

FOREIGN PATENT DOCUMENTS

| | | |
|---|---|---|
| 0309146 | 3/1989 | European Pat. Off. . |
| 0379781 | 8/1990 | European Pat. Off. . |
| 2725727 | 12/1977 | Germany . |
| 54-56847 | 5/1979 | Japan . |
| 54-116231 | 10/1979 | Japan . |
| 55-158984 | 12/1980 | Japan . |
| 58-112746 | 7/1983 | Japan . |
| 59-014964 | 1/1984 | Japan . |
| 5-45163 | 3/1984 | Japan . |
| 59-123670 | 7/1984 | Japan . |
| 59-138461 | 8/1984 | Japan . |
| 60-71260 | 4/1985 | Japan . |
| 60-087056 | 5/1985 | Japan . |
| 63-11350 | 1/1988 | Japan . |
| 63-179751 | 7/1988 | Japan . |

*Primary Examiner*—John Barlow
*Assistant Examiner*—Michael S Brooke
*Attorney, Agent, or Firm*—Fitzpatrick, Cella, Harper & Scinto

[57] ABSTRACT

An ink jet head includes a base member, a first member having recesses and coupled with the base member to form ink passages using the recesses and a second member integral with the first member and extending at an angle from an end of the first member, the second member having ink ejection outlets communicating with the ink passages.

4 Claims, 15 Drawing Sheets

U.S. PATENT DOCUMENTS

| | | | |
|---|---|---|---|
| 4,558,333 | 12/1985 | Sugitani et al. | 347/65 |
| 4,608,577 | 8/1986 | Hori | 347/66 |
| 4,620,202 | 10/1986 | Kato et al. | 347/68 |
| 4,646,110 | 2/1987 | Ikeda et al. | 347/48 |
| 4,701,766 | 10/1987 | Sugitani et al. | 347/47 |
| 4,723,129 | 2/1988 | Endo et al. | 347/56 |
| 4,740,796 | 4/1988 | Endo et al. | 347/56 |
| 4,751,774 | 6/1988 | DeYoung et al. | 29/25.35 |
| 4,774,530 | 9/1988 | Hawkins | 347/63 |
| 4,847,639 | 7/1989 | Sugata et al. | 347/62 |
| 4,949,102 | 8/1990 | Braun | 347/44 |
| 4,951,066 | 8/1990 | Terasawa et al. | 347/33 |
| 4,994,825 | 2/1991 | Saito et al. | 347/47 |
| 5,374,948 | 12/1994 | Saito et al. | 347/47 |
| 5,389,957 | 2/1995 | Kimura et al. | 347/20 |

INK JET APPARATUS

This application is a division of application Ser. No. 08/867,405, filed on Jun. 2, 1997, which is a continuation of application Ser. No. 08/466,723, filed Jun. 6, 1995, now abandoned, which was a divisional of application Ser. No. 08/142,056 filed Oct. 28, 1993 now abandoned, which was a divisional of application Ser. No. 07/940,735, filed Sep. 8, 1992 and now U.S. Pat. No. 5,389,957, which is a continuation of application Ser. No. 07/583,336, filed Sep. 17, 1990, now abandoned.

FIELD OF THE INVENTION AND RELATED ART

The present invention relates to an ink jet apparatus; more particularly an ink jet recording apparatus with ink jet recording head.

Referring first to FIG. 1 which is an exploded view, there is shown an example of an ink jet recording head. The recording head has an orifice plate 400*a* having ink ejection outlets, a top plate 1300*a* with grooves 41*b* for forming ink passages for defining ink passages communicating with the respective ejection outlets and a heater board 100 having heat generating portions 101 in the form of electrothermal transducers for generating thermal energy to eject the ink in the passages. An ink supply port 1500*a* is provided to supply the ink to the ink passages.

Generally speaking, the orifice plate is used to make the surface defining the orifice with the same material to prevent deviation of the ink ejection direction contributable to the difference in the wettability between the top plate and the heater board.

An ink jet recording apparatus having such an ink jet recording head, is equipped with a cap to prevent drying of the ink and to permit an ink ejection recovery operation in which the ink is sucked through the ejection outlets to correct improper ejection.

In addition, when the ink is ejected continuously, for example, the ink droplets may bounced from the recording sheet to the surface of the orifice plate, or an ink mist in the air may accumulate on the surface. This may result in improper ink ejection or in ejection failure. To avoid this problem, the ink on the surface is wiped off by a blade made of rubber or liquid absorbing material.

Since, however, it is difficult to assure the sufficient area for hermetically sealing the orifice plate with the cap, a front seal is bonded around the orifice plate 400*a* to increase the sealing area.

This, however, results in production of a stepped portion between the front seal and the orifice plate 400*a*. Then, when the blade is used to wipe off the residual ink on orifice plate, the ink may remain in the step; the blade skips a part of the orifice plate surface; or the wiping becomes nonuniform by vibration of the blade caused by the step.

SUMMARY OF THE INVENTION

It is an object of the present invention to provide an ink jet apparatus wherein the ink jet head can be capped or wiped in good order.

It is another object of the present invention to provide an ink jet apparatus wherein the residual ink on the orifice plate can be wiped in good order.

It is a further object of the present invention to provide an ink jet apparatus wherein the ink jet head can be hermetically capped in good order.

It is a further object of the present invention to provide an ink jet apparatus wherein the formation of the orifices is easy.

It is a further object of the present invention to provide an ink jet apparatus wherein the orifice plate has sufficient mechanical strength.

It is a further object of the present invention to provide an ink jet apparatus wherein the formation of the ejection outlets is made easier with the flatness of the ejection outlet surface maintained.

It is a further object of the present invention to provide an ink jet apparatus wherein the meniscus of the ink is prevented from withdrawing at the time of the ink jet head being capped, so that the recording operation is stabilized.

It is a further object of the present invention to provide an ink jet apparatus wherein the wiping operation is in good order without remaining foreign matter.

It is a further object of the present invention to provide an ink jet recording apparatus wherein the surface of the orifice plate can be wiped in the direction perpendicular to the line of the orifices and if desired in the direction parallel thereto.

It is a further object of the present invention to provide an ink jet apparatus wherein the ink jet head can be mounted on the ink jet apparatus with a greater latitude.

Referring to FIG. 18, in the ink jet recording head of the above described structure, when a plate like member integral with the top plate is joined with a supporting plate, a bonding agent is supplied to the clearances 10*a* and 10*b* between the ink supply member 5 and the heater board 1 and the top plate 2 with the groove and the cleaner between the orifice and the front end of the supporting plate. The bonding is possible with this method. However, the clearance between the orifice plate 4 and the front end of the supporting plate 3 is very small, and therefore, the sealing agent does not penetrate through the clearance to sufficient extent. For this reason, the bonding is not stable in some case. When the recovery operation is effected with the head of this structure, the hermetically sealed space is not provided between the orifice plate and the supporting plate 3, with the result of insufficient recovery. The same problem arises with the capping operation. In addition, since the bonding strength is not sufficient, they may be separated.

The clearances 10*a* and 10*b* between the head chip constituted by the heater board, supporting plate 3 and the top plate 2 with the grooves are not uniform clearances. Because of the nonuniformity, the sealing material does not penetrate the clearances uniformly, and it does not penetrate sufficiently, or the sealing material is too much at some portions. Then, the head chip and the ink supply member can be separated, and the outer appearance is damaged by the bulged sealing material.

Accordingly, a further object of the present invention is to provide an ink jet head wherein the bonding and sealing is good in between parts.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

FIGS. 2, 3, 4, 5 and 6 illustrate an ink jet unit IJU, an ink jet heat IJH, an ink container IT, an ink jet cartridge IJC, a head carriage HC and a main assembly IJRA of an ink jet recording apparatus, according to an embodiment of the present invention, and relations among them. The structures of the respective elements will be described in the following.

Figure 2:
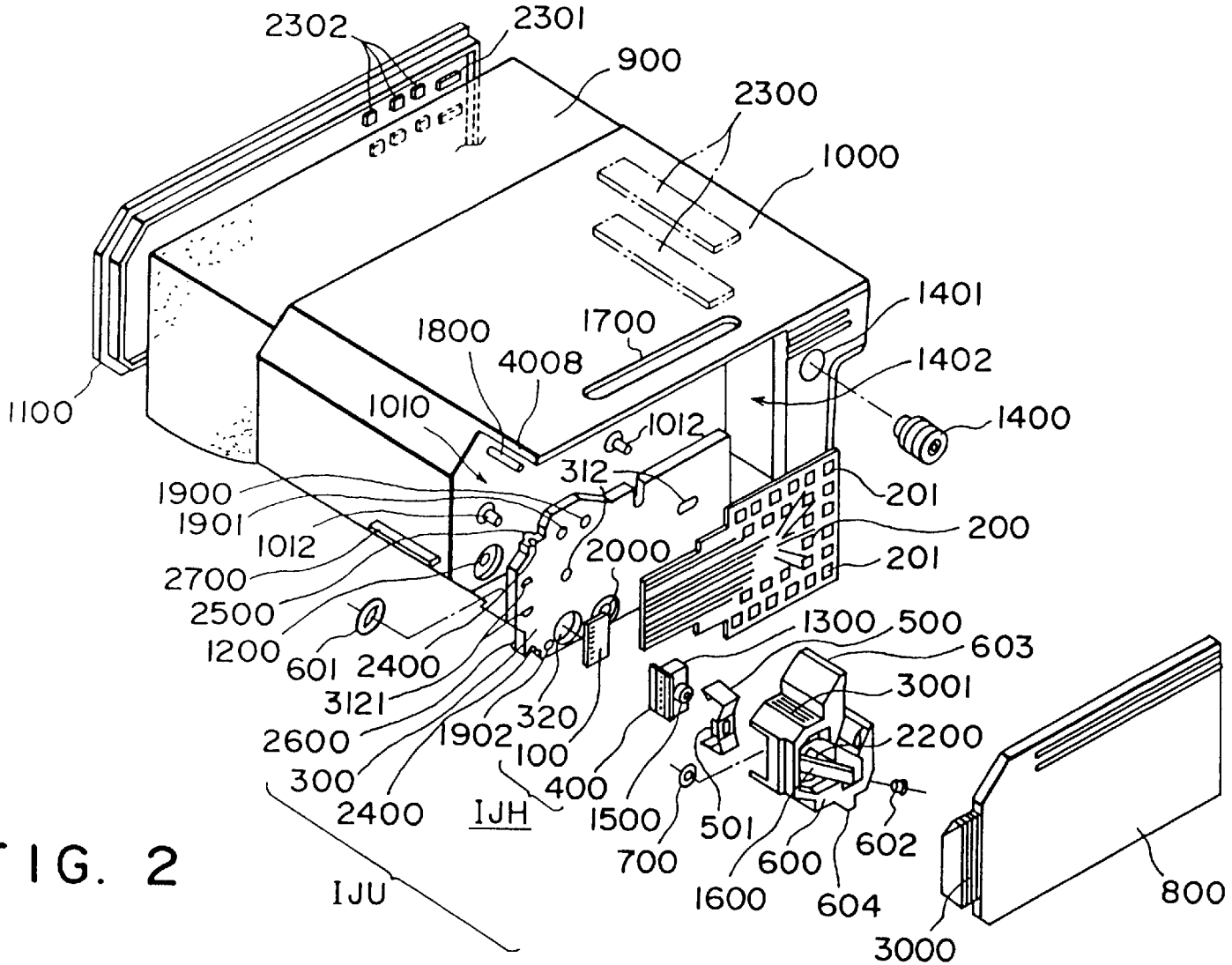
FIG. 2 is an exploded perspective view of an ink jet cartridge according to an embodiment of the present invention.
Figure 3:
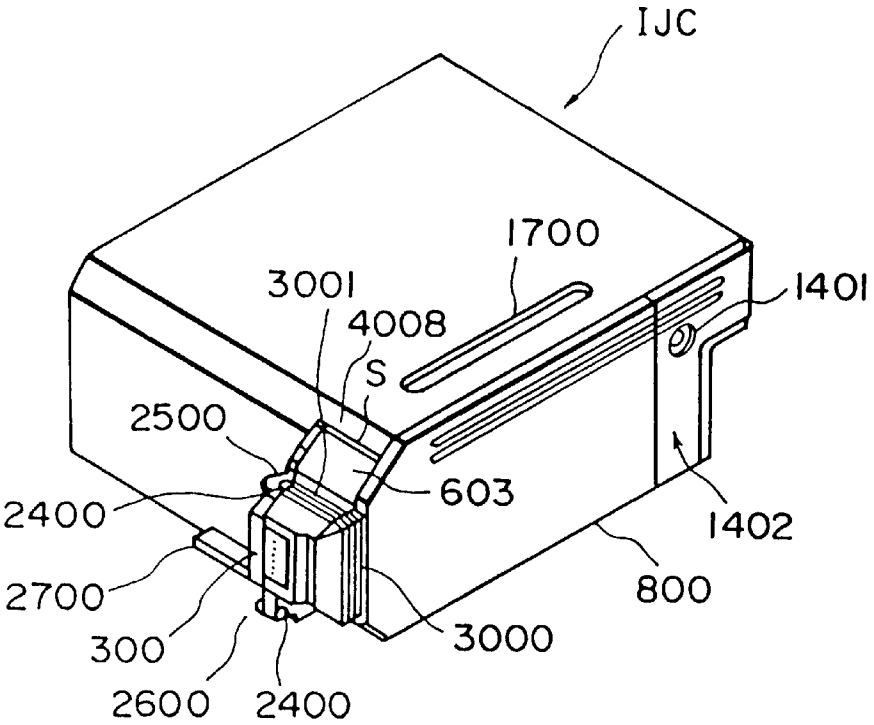
FIG. 3 is a perspective view of an outer appearance of the ink jet cartridge.

As will be understood from the perspective view of FIG. 3, the ink jet cartridge IJC in this embodiment has a relatively large ink accommodation space, and an end portion of the ink jet unit IJU is slightly projected from the front side surface of the ink container IT. The ink jet cartridge IJC is mountable at correct position on the carriage HC (FIG. 5) of the ink jet recording apparatus main assembly IJRA by proper positioning means and with electric contacts, which will be described in detail hereinafter. It is, in this embodiment, a disposable type head detachably mountable on the carriage AC. The structures disclosed in FIGS. 2–6 contain various novel features, which will first be described generally.

(i) Ink Jet Unit IJU

The ink jet unit IJU is of a bubble jet recording type using electrothermal transducers which generate thermal energy, in response to electric signals, to produce film boiling of the ink.

Referring to FIG. 2, the unit comprises a heater board 100 having electrothermal transducers (ejection heaters) arranged in a line on an Si substrate and electric lead lines made of aluminum or the like to supply electric power thereto. The electrothermal transducer and the electric leads are formed by a film forming process. A wiring board 200 is associated with the heater board 100 and includes wiring corresponding to the wiring of the heater board 100 (connected by the wire bonding technique, for example) and pads 201 disposed at an end of the wiring to receive electric signals from the main assembly of the recording apparatus.

A top plate 1300 is provided with grooves which define partition walls for separating adjacent ink passages and a common liquid chamber for accommodating the ink to be supplied to the respective ink passages. The top plate 1300 is formed integrally with an ink jet opening 1500 for receiving the ink supplied from the ink container IT and directing the ink to the common chamber, and also with an orifice plate 400 having the plurality of ejection outlets corresponding to the ink passages. The material of the integral mold is preferably polysulfone, but may be another molding resin material.

A supporting member 300 is made of metal, for example, and functions to support a backside of the wiring board 200 in a plane, and constitutes a bottom plate of the ink jet unit IJU. A confining spring 500 is in the form of "M" having a central portion urging to the common chamber with a light pressure, and a clamp 501 urges concentratedly with a line pressure to a part of the liquid passage, preferably the part in the neighborhood of the ejection outlets. The confining spring 500 has legs for clamping the heater board 100 and the top plate 1300 by penetrating through the openings 3121 of the supporting plate 300 and engaging the back surface of the supporting plate 300. Thus, the heater board 100 and the top plate 1300 are clamped by the concentrated urging force by the legs and the clamp 501 of the spring 500. The supporting plate 300 has positioning openings 312, 1900 and 2000 engageable with two positioning projections 1012 and positioning and fuse-fixing projections 1800 and 1801 of the ink container IT. It further includes projections 2500 and 2600 at its backside for the positioning relative to the carriage HC of the main assembly IJRA.

In addition, the supporting member 300 has a hole 320 through which an ink supply pipe 2200, which will be described hereinafter, is penetrated for supplying ink from the ink container. The wiring board 200 is mounted on the supporting member 300 by bonding agent or the like. The supporting member 300 is provided with recesses 2400 and 2400 adjacent the positioning projections 2500 and 2600.

Figure 5:
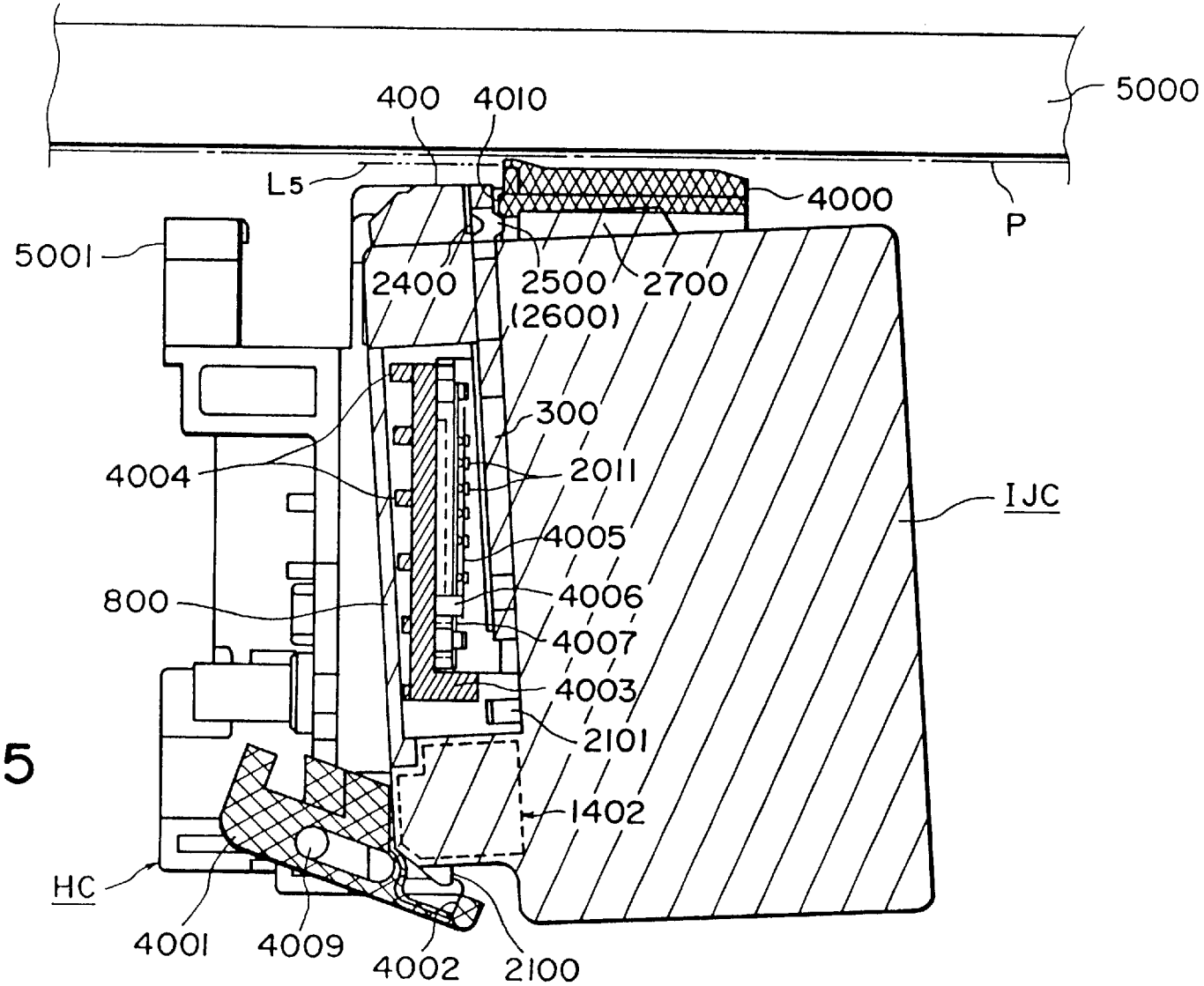
FIG. 5 is a top plan view of the ink jet cartridge to be mounted on the cartridge of the ink jet apparatus.

As shown in FIG. 3, the assembled ink jet cartridge IJC has a head projected portion having three sides provided with plural parallel grooves 3000 and 3001. The recesses 2400 and 2400 are located at extensions of the parallel grooves at the top and bottom sides to prevent the ink or foreign matter moving along the groove from reaching the projections 2500 and 2600. The covering member 800 having the parallel grooves 3000, as shown in FIG. 5, constitutes an outer casing of the ink jet cartridge IJC and cooperates with the ink container to define a space for accommodating the ink jet unit IJU. The ink supply member 600 having the parallel groove 3001 has an ink conduit pipe 1600 communicating with the above-described ink supply pipe 2200 and cantilevered at the supply pipe 2200 side. In order to assure the capillary action at the fixed side of the ink conduit pipe 1600 and the ink supply pipe 2200, a sealing pin 602 is inserted.

A gasket 601 seals the connecting portion between the ink container IT and the supply pipe 2200. A filter 700 is disposed at the container side end of the supply pipe. The ink supply member 600 is molded, and therefore, it is produced at low cost with high positional accuracy. In addition, the cantilevered structure of the conduit 1600 assures the press-contact between the conduit 1600 and the ink inlet 1500 even if the ink supply member 600 is mass-produced.

In this embodiment, the complete communicating state can be assuredly obtained simply by flowing sealing bonding agent from the ink supply member side under the press-contact state. The ink supply member 600 may be fixed to the supporting member 300 by inserting and penetrating backside pins (not shown) of the ink supply member 600 through the openings 1901 and 1902 of the supporting member 300 and by heat-fusing the portion where the pins are projected through the backside of the supporting member 300. The slight projected portions thus heat-fused are accommodated in recesses (not shown) in the ink jet unit (IJU) mounting side surface of the ink container IT, and therefore, the unit IJU can be correctly positioned.

(ii) Ink Container IT

The ink container comprises a main body 1000, an ink absorbing material and a cover member 1100. The ink absorbing material 900 is inserted into the main body 1000 from the side opposite from the unit (IJU) mounting side, and thereafter, the cover member 1100 seals the main body.

The ink absorbing material 900 is thus disposed in the main body 1000. The ink supply port 1200 functions to supply the ink to the ink jet unit IJU comprising the above-described parts 100–600, and also functions as an ink injection inlet to permit initial ink supply to the absorbing material 900 before the unit IJU is mounted to the portion 1010 of the main body.

In this embodiment, the ink may be supplied through an air vent port and this supply opening. In order to ensure good supply of ink, ribs 2300 are formed on the inside surface of the main body 1000, and ribs 2301 and 2302 are formed on the inside of the cover member 1100, which are effective to provide within the ink container an ink existing region extending continuously from the air vent port side to that corner portion of the main body which is most remote from the ink supply opening 1200. Therefore, in order to uniformly distribute the ink in good order, it is preferable that the ink is supplied through the supply opening 1200. This ink supply method is practically effective. The number of the ribs 2300 in this embodiment is four, and the ribs 2300 extend parallel to a movement direction of the carriage adjacent the rear side of the main body of the ink container, by which the absorbing material 900 is prevented from closely contacting to the inner surface of the rear side of the main body. The ribs 2301 and 2302 are formed on the inside surface of the cover member 1100 at a position which is substantially an extension of the ribs 2300, however, as contrasted to the large rib 2300, the size of the ribs 2301 and 2302 are small as if they are divided ribs, so that the air existing space is larger with the ribs 2301 and 2302 than with the ribs 2300. The ribs 2302 and 2301 are distributed on the entire area of the cover member 1100, and the area thereof is not more than one half of the total area. Because of the provision of the ribs, the ink in the corner region of the ink absorbing material which is most remote from the supply opening 1200 can be stably and assuredly supplied to the inlet opening by capillary action. The cartridge is provided with an air vent port for communication between the inside of the cartridge with the outside air. Inside the vent port 1400, there is a water repellent material 1400 to prevent the inside ink from leaking outside through the vent port 1400.

The ink accommodating space in the ink container IT is substantially rectangular parallelepiped, and the long side faces in the direction of carriage movement, and therefore, the above-described rib arrangements are particularly effective. When the long side extends along the movement direction of the carriage, or when the ink containing space is in the form of a cube, the ribs are preferably formed on the entire surface of the inside of the cover member 1100 to stabilize the ink supply from the ink absorbing material 900. The cube configuration is preferable from the standpoint of accommodating as much as possible ink in limited space. However, from the standpoint of using the ink with minimum an available part in the ink container, the provisions of the ribs formed on the two surfaces constituting a corner.

In this embodiment, the inside ribs 2301 and 2302 of the ink container IT are substantially uniformly distributed in the direction of the thickness of the ink absorbing material having the rectangular parallelepiped configuration. Such a structure is significant, since the air pressure distribution in the ink container IT is made uniform when the ink in the absorbing material is consumed so that the quantity of the remaining unavailable ink is substantially zero. It is preferable that the ribs are disposed on the surface or surfaces outside a circular arc having its center at the projected position on the ink supply opening 1200 on the top surface of the rectangular ink absorbing material and having a radius which is equal to the long side of the rectangular shape, since then the ambient air pressure is quickly established for the ink absorbing material present outside the circular arc. The position of the air vent of the ink container IT is not limited to the position of this embodiment if it is good for introducing the ambient air into the position where the ribs are disposed.

In this embodiment, the backside of the ink jet cartridge IJC is flat, and therefore, the space required when mounted in the apparatus is minimized, while maintaining the maximum ink accommodating capacity. Therefore, the size of the apparatus can be reduced, and simultaneously, the frequency of the cartridge exchange is minimized. Utilizing the rear space of the space used for unifying the ink jet unit IJU, a projection for the air vent port 1401 is provided. The inside of the projection is substantially vacant, and the vacant space 1402 functions to supply the air into the ink container IT uniformly in the direction of the thickness of the absorbing material. Because of these features described above, the cartridge as a whole is of better performance than the conventional cartridge. The air supply space 1402 is much larger than that in the conventional cartridge. In addition, the air vent port 1401 is at an upper position, and therefore, if the ink departs from the absorbing material for some reason or another, the air supply space 1402 can tentatively retain the ink to permit such ink to be absorbed back into the absorbing material. Therefore, the wasteful consumption of the ink can be saved.

Figure 4:
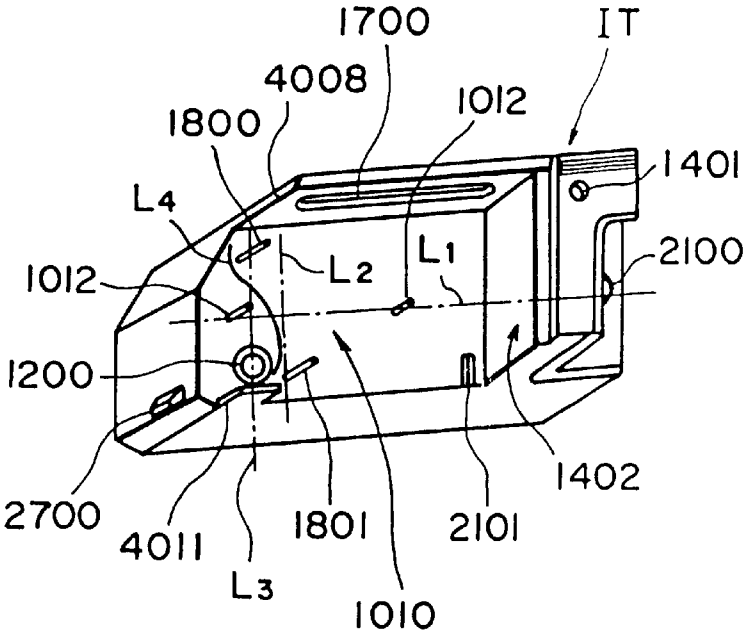
FIG. 4 is a perspective view of an outer appearance of the ink container of the ink jet cartridge as seen from the side at which the ink jet recording head is mounted.

Referring to FIG. 4, there is shown a structure of a surface of the ink container IT to which the unit IJU is mounted. Two positioning projections 1012 are on a line L1 which is a line passing through the substantial center of the array of the ejection outlets in the orifice plate 400 and parallel with the bottom surface of the ink container IT or the parallel to the ink container supporting reference surface of the carriage.

The height of the projections 1012 is slightly smaller than the thickness of the supporting member 300, and the projections 1012 function to correctly position the supporting member 300. On an extension (right side) in this Figure, there is a pawl 2100 with which a right angle engaging surface 4002 of a carriage positioning hook 4001 is engageable. Therefore, the force for the positioning of the ink jet unit relative to the carriage acts in a plane parallel to a reference plane including the line L1. These relationships are significant, since the accuracy of the ink container positioning becomes equivalent to the positioning accuracy of the ejection outlet of the recording head, which will be described hereinafter in conjunction with FIG. 5.

Projections 1800 and 1801 corresponding to the fixing holes 1900 and 2000 for fixing the supporting member 300 to the side of the ink container IT, are longer than the projections 1012, so that they penetrate through the supporting member 300, and the projected portions are fused to fix the supporting member 300 to the side surface. When a line L3 passing through the projection 1800 and perpendicular to the line L1, and a line L2 passing through the projection 1801 and perpendicular to the line L1, are drawn. The center of the supply opening 1200 is substantially on the line L3, the connection between the supply opening 1200 and a supply type 2200 is stabilized, and therefore, even if the cartridge falls, or even if a shock is imparted to the cartridge, the force applied to the connecting portion can be minimized. In addition, since the lines L2 and L3 are not overlapped, and since the projections 1800 and 1801 are disposed adjacent to that projection 1012 which is nearer to the ink ejection outlets of the ink jet head, the positioning of the ink jet unit relative to the ink container is further improved. In this Figure, a curve L4 indicates the position of the outer wall of the ink supply member 600 when it is mounted. Since the projections 1800 and 1801 are along the curve L4, the projections are effective to provide sufficient mechanical strength and positional accuracy against the weight of the end structure of the head IJH.

An end projection 2700 of the ink container IT is engageable with a hole formed in the front plate 4000 of the carriage to prevent the ink cartridge from being displaced extremely out of the position. A stopper 2101 is engageable with an unshown rod of the carriage HC, and when the cartridge IJC is correctly mounted with rotation, which will be described hereinafter, the stopper 2101 take a position below the rod, so that even if an upward force tending to disengage the cartridge from the correct position is unnecessarily applied, the correct mounted state is maintained. The ink container IT is covered with a cover 800 after the unit IJU is mounted thereto. Then, the unit IJU is enclosed therearound except for the bottom thereof. However, the bottom opening thereof permits the cartridge IJC to be mounted on the carriage HC, and is close to the carriage HC, and therefore, the ink jet unit is substantially enclosed at the six sides. Therefore, the heat generation from the ink jet head IJH which is in the enclosed space is effective to maintain the temperature of the enclosed space.

However, if the cartridge IJC is continuously operated for a long period of time, the temperature slightly increases. Against the temperature increase, the top surface of the cartridge IJC is provided with a slit 1700 having a width smaller than the enclosed space, by which the spontaneous heat radiation is enhanced to prevent the temperature rise, while the uniform temperature distribution of the entire unit IJU is not influenced by the ambient conditions.

After the ink jet cartridge IJC is assembled, the ink is supplied from the inside of the cartridge to the chamber in the ink supply member 600 through a supply opening 1200, the hole 320 of the supporting member 300 and an inlet formed in the backside of the ink supply member 600. From the chamber of the ink supply member 600, the ink is supplied to the common chamber through the outlet, supply pipe and an ink inlet 1500 formed in the top plate 1300. The connecting portion for the ink communication is sealed by silicone rubber or butyl rubber or the like to assure the hermetical seal.

In this embodiment, the top plate 1300 is made of resin material having resistivity to the ink, such as polysulfone, polyether sulfone, polyphenylene oxide, polypropylene. It is integrally molded in a mold together with an orifice plate portion 400.

As described in the foregoing, the integral part comprises the ink supply member 600, the top plate 1300, the orifice plate 400 and parts integral therewith, and the ink container body 1000. Therefore, the accuracy in the assembling is improved, and is convenient in the mass-production. The number of parts is smaller than inconventional device, so that the good performance can be assured.

In this embodiment, as shown in FIGS. 2–4, the configuration after assembly is such that the top portion 603 of the ink supply member 600 cooperates with an end of the top thereof having the slits 1700, so as to form a slit S, as shown in FIG. 3. The bottom portion 604 cooperates with fed side end 4011 of a thin plate to which the bottom cover 800 of the ink container IT is bonded, so as to form a slit (not shown) similar to the slit S. The slits between the ink container IT and the ink supply member 600 are effective to enhance the heat radiation, and is also effective to prevent an expected pressure to the ink container IT from influencing directly the supply member or to the ink jet unit IJT.

The above-described various structures are individually effective to provide the respective advantages, and also they are most effective when they are combined each other.

(iii) Mounting of the Ink Jet Cartridge IJC to the Carriage HC

In FIG. 5, a platen roller 5000 guides the recording medium P from the bottom to the top. The carriage HC is movable along the platen roller 5000. The carriage HC comprises a front plate 4000, a supporting plate 4003 for electric connection and a positioning hook 4001. The front plate 400 has a thickness of 2 mm, and is disposed closer to the platen. The front plate 4000 is disposed close to the front side of the ink jet cartridge IJC, when the cartridge IJC is mounted to the carriage. The supporting plate 4003 supports a flexible sheet 4005 having pads 2011 corresponding to the pads 201 of the wiring board 200 of the ink jet cartridge IJC and a rubber pad sheet 4007 for producing elastic force for urging the backside of the flexible sheet 4005 to the pads 2001. The positioning hook 4001 functions to fix the ink jet cartridge IJC to the recording position. The front plate 4000 is provided with two positioning projection surfaces 4010 corresponding to the positioning projections 2500 and 2600 of the supporting member 300 of the cartridge described hereinbefore. After the cartridge is mounted, the front plate receives the force in the direction perpendicular to the projection surfaces 4010. Therefore, plural reinforcing ribs (not shown) are extended in the direction of the force at the platen roller side of the front plate. The ribs project toward the platen roller slightly (approximately 0.1 mm) from the front side surface position L5 when the cartridge IJC is mounted, and therefore, they function as head protecting projections. The supporting plate 4003 is provided with plural reinforcing ribs 4004 extending in a direction perpendicular to the above-described front plate ribs. The reinforcing ribs 4004 have heights which decrease from the plate roller side to the hook 4001 side. By this, the cartridge is inclined as shown in FIG. 5, when it is mounted.

The supporting plate 4003 is provided with two additional positioning surfaces 4006 at the lower left portion, that is, at the position closer to the hook. The positioning surfaces 4006 correspond to projection surfaces 4010 by the additional positioning surfaces 4006, the cartridge receives the force in the direction opposite from the force received by the cartridge by the above-described positioning projection surfaces 4010, so that the electric contacts are stabilized. Between the upper and lower projection surfaces 4010, there is disposed a pad contact zone, so that the amount of deformation of the projections of the rubber sheet 4007 corresponding to the pad 2011 is determined. When the cartridge IJC is fixed at the recording position, the positioning surfaces are brought into contact with the surface of the supporting member 300. In this embodiment, the pads 201 of the supporting member 300 are distributed so that they are symmetrical with respect to the above-described line L1, and therefore, the amount of deformation of the respective projections of the rubber sheet 4007 are made uniform to stabilize the contact pressure of the pads 2011 and 201. In this embodiment, the pads 201 are arranged in two columns and upper and bottom two rows.

The hook 4001 is provided with an elongated whole engageable with a fixed pin 4009. Using the movable range provided by the elongated hole, the hook 4001 rotates in the counterclockwise direction, and thereafter, it moves leftwardly along the platen roller 5000, by which the ink jet cartridge IJC is positioned to the carriage HC. Such a movable mechanism of the hook 4001 may be accomplished by another structure, but it is preferable to use a lever or the like. During the rotation of the hook 4001, the cartridge IJC moves from the position shown in FIG. 5 to the position toward the platen side, and the positioning projections 2500 and 2600 come to the position where they are engageable to the positioning surfaces 4010. Then, the hook 4001 is moved leftwardly, so that the hook surface 4002 is contacted to the pawl 2100 of the cartridge IJC, and the ink cartridge IJC rotates about the contact between the positioning surface 2500 and the positioning projection 4010 in a horizontal plane, so that the pads 201 and 2011 are contacted to each other. When the hook 4001 is locked, it is retained at the fixing or locking position, by which the complete contacts are simultaneously established between the pads 201 and 2011, between the positioning portions 2500 and 4010, between the standing surface 4002 and the standing surface of the pawl and between the supporting member 300 and the positioning surface 4006, and therefore, the cartridge IJC is completely mounted on the carriage.

(iv) General Arrangement of the Apparatus

Figure 6:
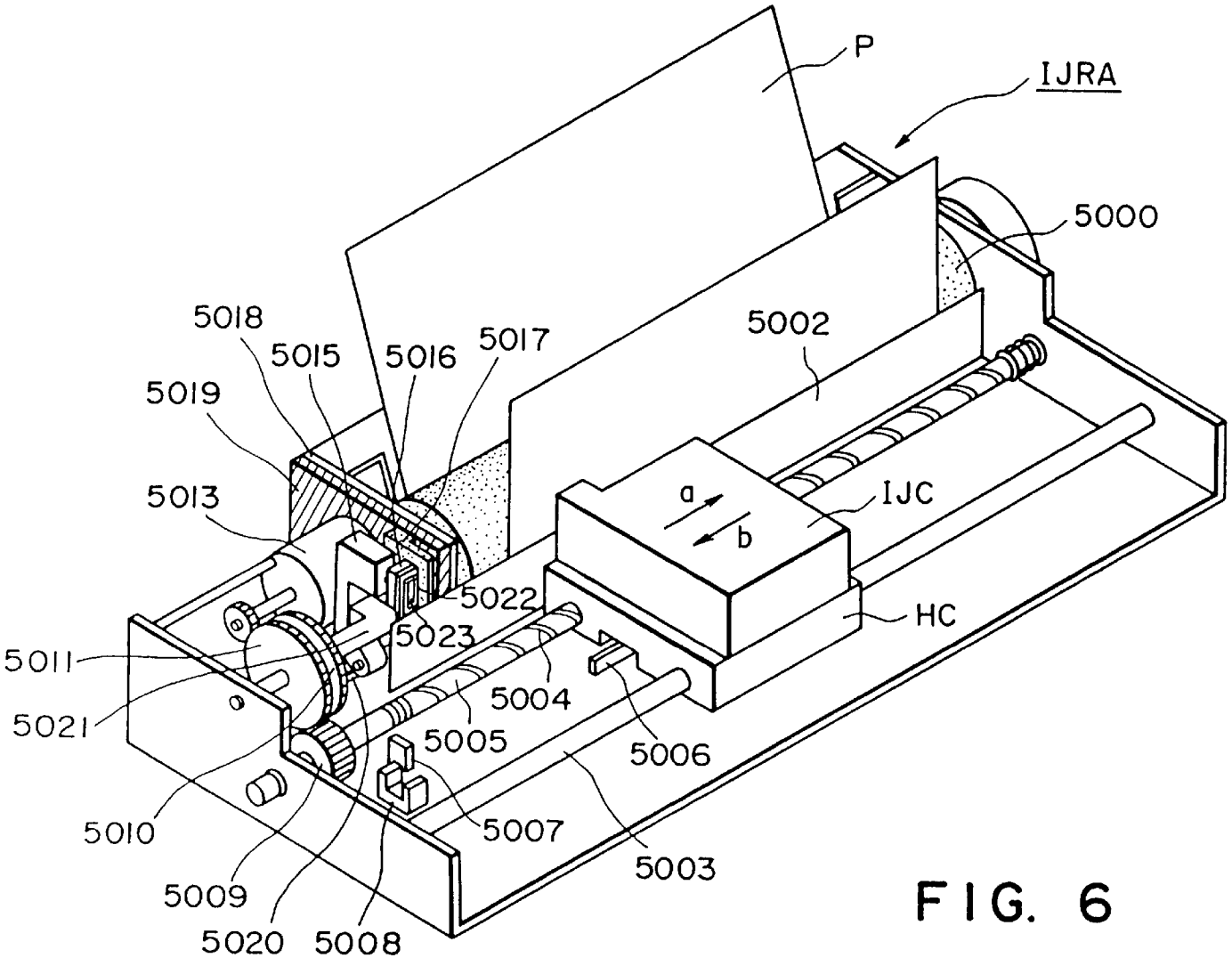
FIG. 6 is a perspective view of an ink jet apparatus according to an embodiment of the present invention.

FIG. 6 is a perspective view of an ink jet recording apparatus IJRA in which the present invention is used. A lead screw 5005 rotates by way of a drive transmission gears 5011 and 5009 by the forward and backward rotation of a driving motor 5013. The lead screw 5005 has a helical groove 5004 with which a pin (not shown) of the carriage HC is engaged, by which the carriage HC is reciprocable in directions a and b. A sheet confining plate 5002 confines the sheet on the platen over the carriage movement range. Home position detecting means 5007 and 5008 are in the form of a photocoupler to detect presence of a lever 5006 of the carriage, in response to which the rotational direction of the motor 5013 is switched. A supporting member 5016 supports the front side surface of the recording head to a capping member 5022 for capping the recording head. Sucking means 5015 functions to suck the recording head through the opening 5023 of the cap so as to recover the recording head.

A cleaning blade 5017 is moved toward front and rear by a moving member 5019. They are supported on the supporting frame 5018 of the main assembly of the apparatus. The blade may be in another form, more particularly, a known cleaning blade. A lever 5021 is effective to start the sucking recovery operation and is moved with the movement of a cam 5020 engaging the carriage, and the driving force from the driving motor is controlled by known transmitting means such as clutch or the like.

The capping, cleaning and sucking operations can be performed when the carriage is at the home position by the lead screw 5005, in this embodiment. However, the present invention is usable in another type of system wherein such operations are effected at different timing. The individual structures are advantageous, and in addition, the combination thereof is further preferable.

(Embodiment 1)

Figure 7:
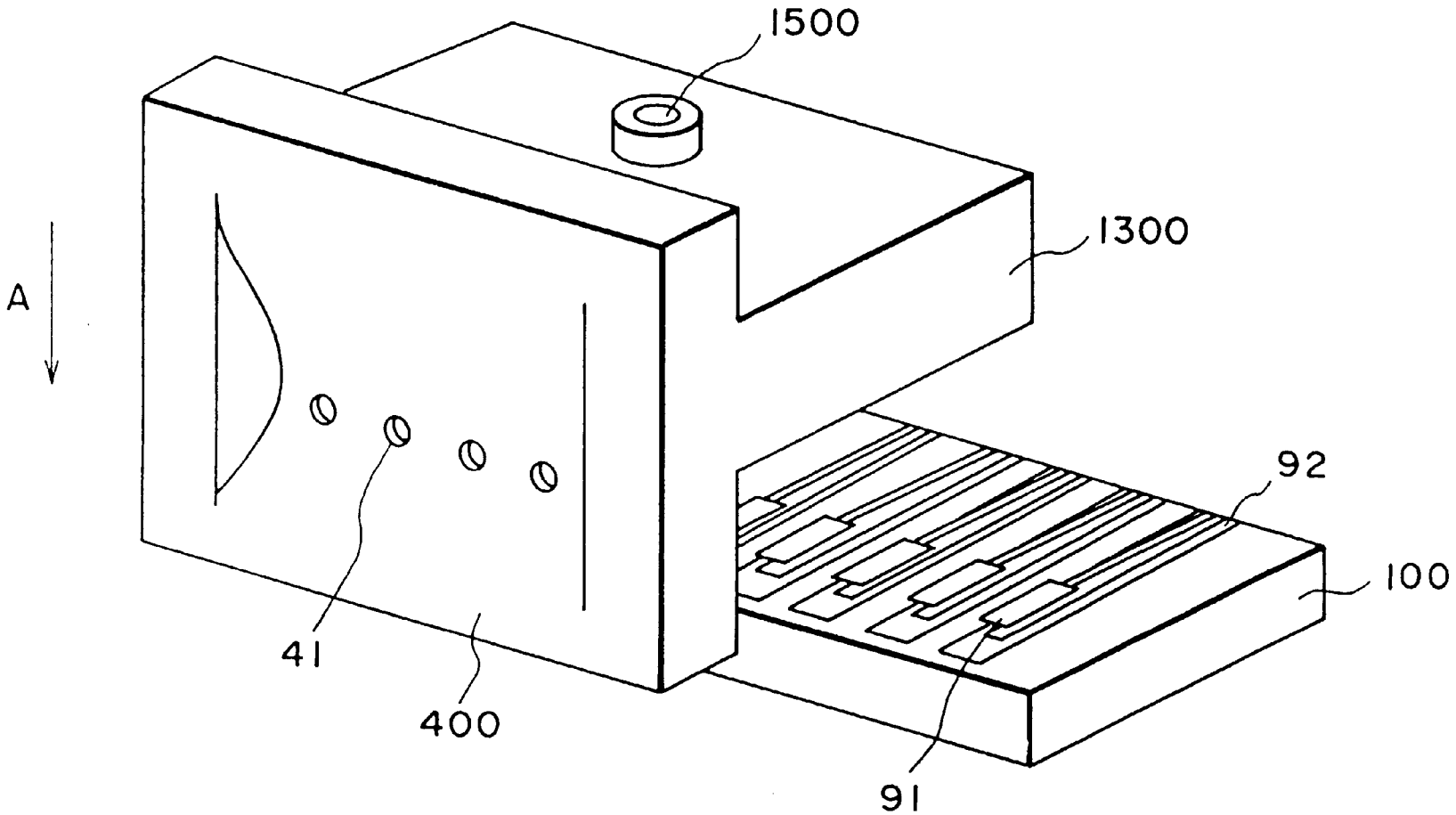
FIG. 7 is an exploded perspective view of an ink jet head according to an embodiment of the present invention.

FIG. 7 is a perspective view of an integrated orifice plate and the top plate with grooves (recesses) and the orifice plate and the perspective view of the heater board (base member) 100. Reference numeral 41 is an ejection port or outlet formed in the orifice plate having a thickness of 200 microns using excimer laser; reference numeral 1500 designates an ink receptor for supplying ink to the ink passage formed by joining the top plate and the heater board 100. Reference numeral 91 designates a heat generating portion (heater) functioning as an electrothermal transducer for generating thermal energy contributable to ejection of the ink; reference numeral 92 designates an electrode of aluminum for supplying electric pulses to the heat generating portion. The ink passages are filled with the ink through the ink receptor.

By supplying electric pulses to the heaters 91 in accordance with the input data, the vapor is produced from the ink on the heater, by which the ink is projected through the ejection outlet in the form of droplets. The droplets reaches the surface of the sheet which is disposed approx. 0.5–1.0 mm away from the ejection outlet, to form the image in accordance with the input information.

In this embodiment, the top plate and the orifice plate extending upwardly and downwardly from the end of the top plate are molded integrally, and the thickness of the main body of the orifice plate is approx. 200 microns to assure the mechanical strength. In consideration of the outlet forming process using the excimer laser, only the outlet formation portion of orifice plate is made to have the thickness of approx. 10–50 microns, and the thickness is increased away from the outlet forming portion of ejection outlet. Further, in consideration of the mechanical strength and the sealing performance upon the head capping, the opposite end portions thereof in the direction of the array of the ejection outlets have the thickness of 200 microns which is the same as the thickness of the main body.

The material of the integral member constituting the top plate and orifice plate is preferably polyether ketone, polyimide polysulfon or the like form the standpoint of low cost and the resistivity against the ink. In this embodiment, the use is made with polysulfon in view of the small thermal deformation.

With the ink jet head of the above structure was operated for a sucking and recovery operation. As compared with the case wherein the front plate is made of separate member, the orifice plate made of a large area one plate integrally molded or mounted top plate has a large area of the ejection side surface, so that the contact with the cap is improved. Further, since the ejection side surface does not have a stepped portion, so that the contact surface with the cap is smooth. It has been confirmed, the good sealing property has been provided with sufficient sucking action. In the case of the wiping operation wherein the cleaning member slides on the surface in the direction indicated by an arrow A, the blade does not vibrate, and the ink does not remain so that the ink has been sufficiently removed, since the surface is smooth contoured so as to be smoothly curvilinear in the wiping direction (perpendicular to the array of the ejection outlets). In addition, the marginaly area of the orifice plate has a larger thickness, and therefore, the high strength is assured. The orifice plate 400 is not creased or damaged due to the insufficient mechanical strength.

(Embodiment 2)

The structure was the same as in Embodiment 1 with the exception that only the orifice plate 400 is modified. The ink sucking operation was performed.

Figure 8:
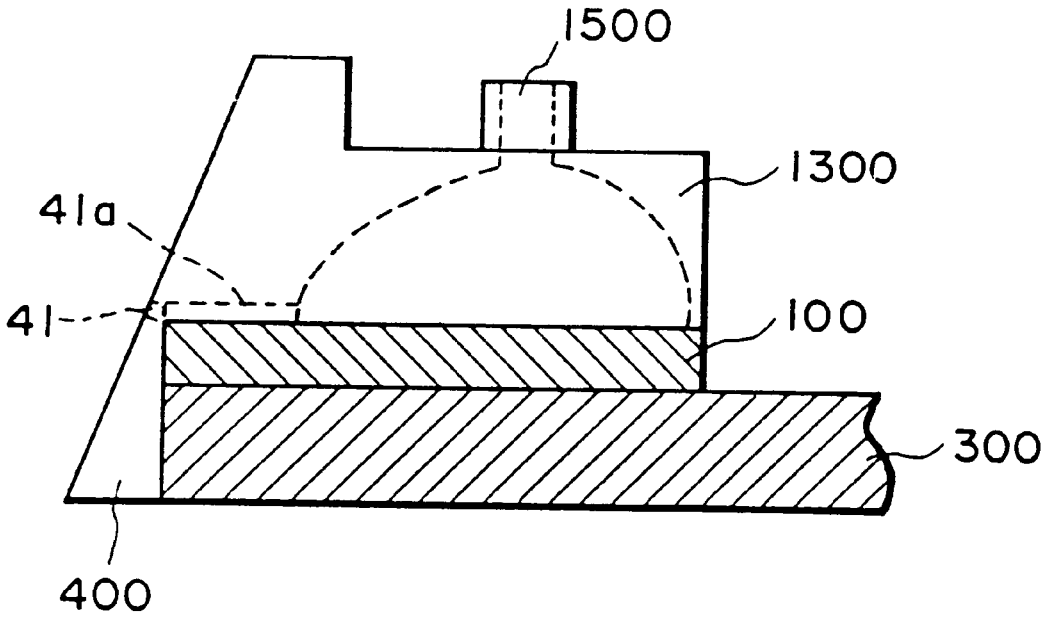
FIG. 8 is a side view of an ink jet head according to another embodiment of the present invention.

FIG. 8 is a side view illustrating the device of Embodiment 2. The same reference numerals as in the Embodiment 1 are assigned to the elements having the corresponding functions, with the exception that a reference numeral 300 has an aluminum supporting plate, and a reference numeral 41*a* designates an ink passage communicating with the ejection outlets 41.

In this embodiment, the top plate 1300 and the orifice plate 400 are molded integrally, and the thickness of the orifice plate 400 is made 200 microns at maximum to provide mechanical strength thereof. The orifice plate has an inclined portion, and the thickness of the ejection outlet portion 41 is 10–50 microns to make the hole formation (ejection outlets) easier.

The ejection side surface of the orifice plate 41 is substantially flush with the other part, by which the close contact with the cap is improved.

By doing so, the contact area with the cap is assured without the stepped portion, so that the sealing is very good, and the sucking operation was in good order. This has been confirmed by the actual sucking operation. Also, the ink wiping operation has been confirmed to be good because of the absence of the ink ejection side surface using the tapered surface with smooth contact and separation of the blade relative to the ejection side surface. The ink has not remained, and therefore, the residual ink has been removed to the sufficient extent.

(Embodiment 3)

The structure of this embodiment is the same as the first embodiment with the exception that the orifice plate 400 is modified. The actual sucking and wiping operation have been performed.

Figure 9:
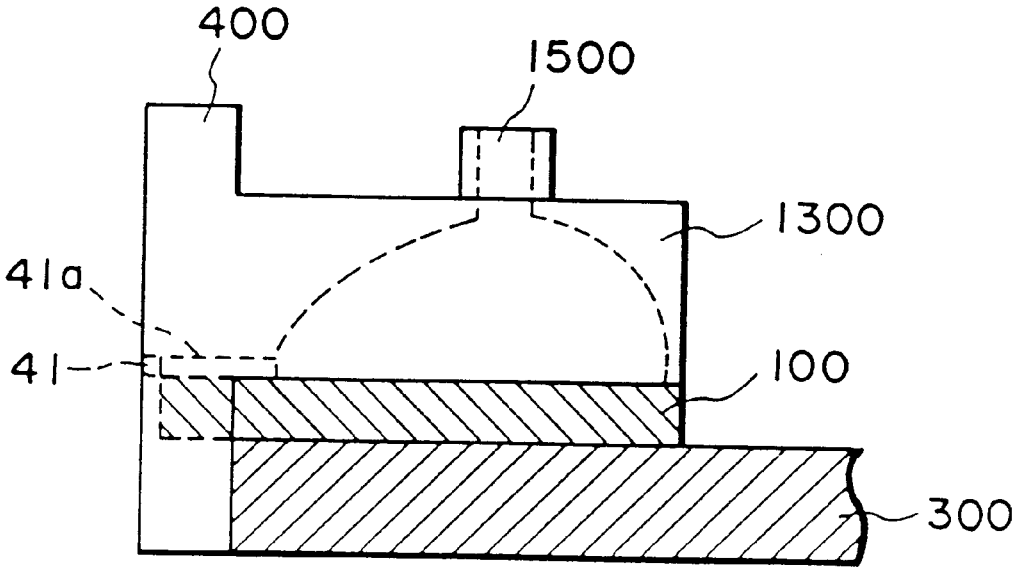
FIG. 9 is a side view of an ink jet head according to a further object of the present invention.

FIG. 9 is a side view illustrating embodiment 3. Also, in this embodiment, the top plate 1300 with the grooves and the orifice plate 400 are molded integrally, and the thickness of the orifice plate 400 is 200 microns at maximum to provide sufficient mechanical strength. The ejection side surface of the orifice plate 400 is made flush with the other part, and the thickness of the orifice plate 400 is 100–50 microns at the portion of the heater board. In the orifice plate 400, the heater board 100 is implanted. Since the thickness of the ejection outlet portion is reduced, the machinability or the like is improved.

When the sucking operation is carried out, the good sealing has been confirmed, and the sucking operation has been performed in good order. Because of the lack of the stepped portion on the ejection side surface, the ink wiping operation has been confirmed good without vibration of the blade or the like, and no ink remains at particular portion, so that the residual ink has been removed sufficiently.

In the foregoing embodiments, as described, the top plate with the grooves and the orifice plate are molded integrally. As compared with the case wherein a separate front plate is mounted, the sealing at the time of the capping is improved, and therefore, the sucking operation can be improved. In addition, since the ejection outlet side surface is a continuous smooth surface, the wiping operation can be performed in good order. Thus, the recovery operation is assured in the ink jet head. The necessity for mounting the front plate is eliminated, and therefore, the number of parts is reduced with the advantage of improved accuracy of the head by the integral molding, and therefore, a reliable ink jet head and the reliable apparatus using the same can be provided.

In addition, since the thickness of the orifice plate is minimum at the ejection outlet portion, the high accuracy formation of the ejection holes can be easily made without deteriorating the sufficient mechanical strength of the orifice plate.

(Embodiment 4)

Figure 1:
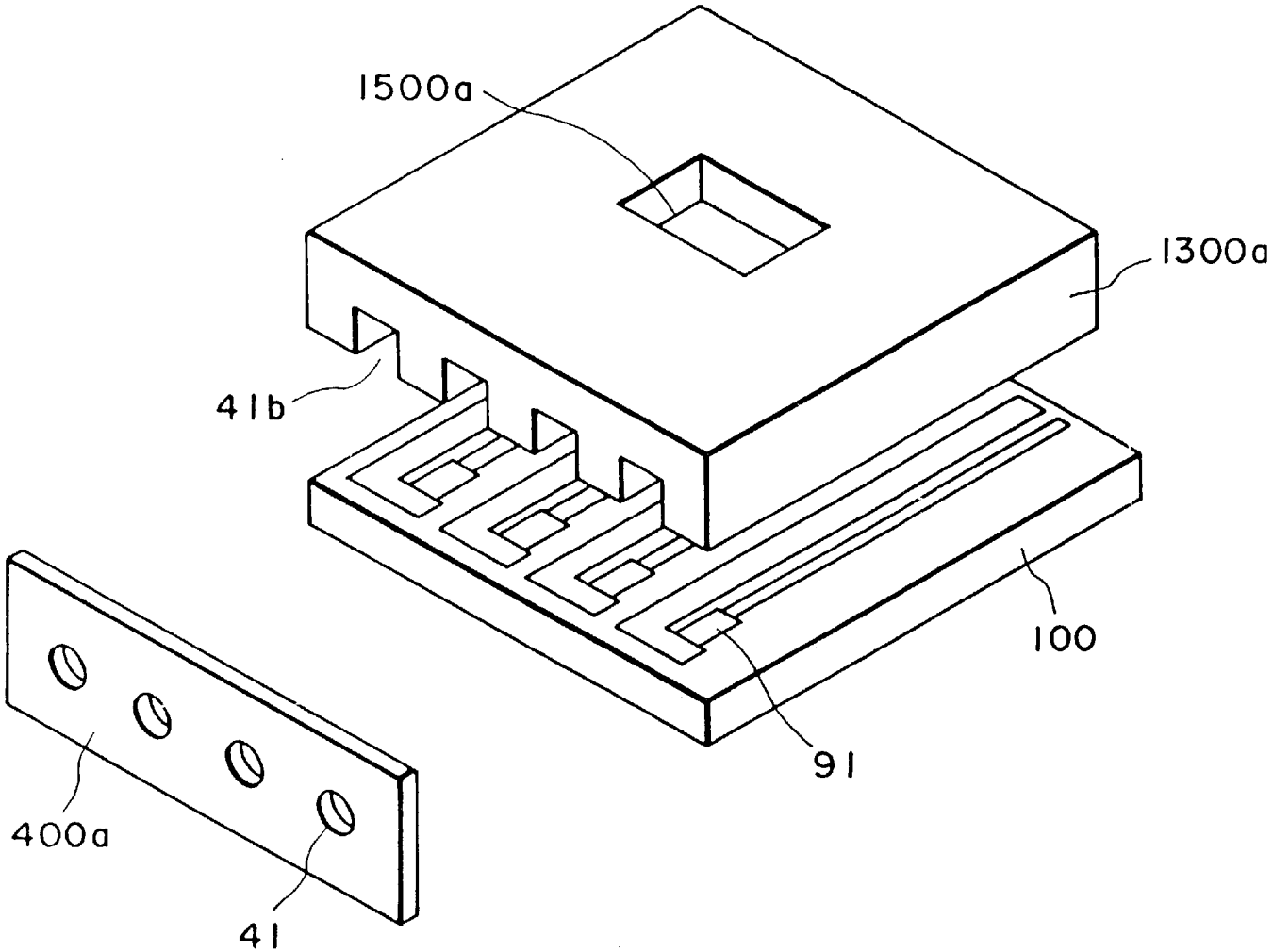
FIG. 1 PRIOR ART
FIG. 1 is an exploded perspective view of an ink jet head from which the present invention starts.
Figure 10:
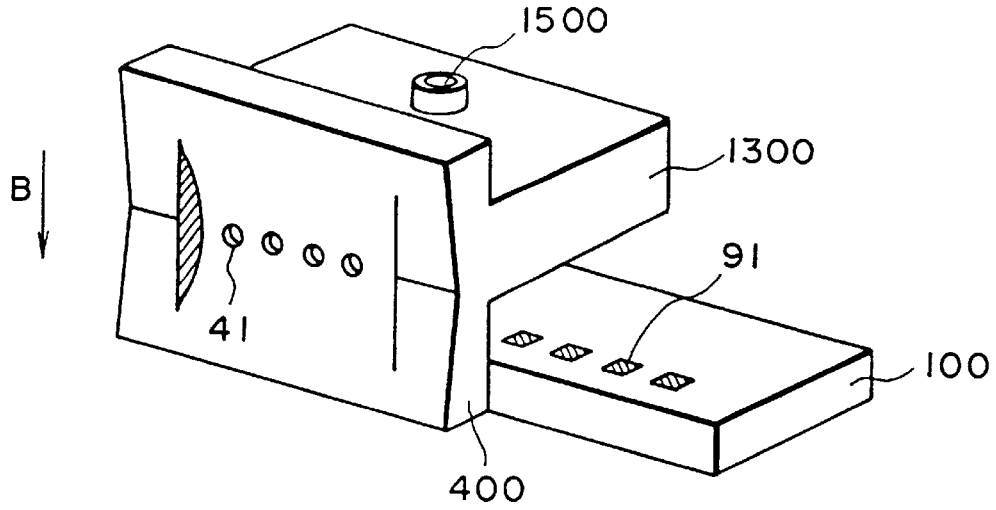
FIG. 10 is an exploded view of an ink jet head according to a yet further object of the present invention.

The structure of this embodiment is similar to that of FIG. 1 embodiment. However, in this embodiment, as shown in FIG. 10 the thickness of the orifice plate is slightly smaller at opposite end portions thereof in the direction of the line of the ejection outlets than the other portion thereof in consideration of the mechanical strength and in view of the pressure adjustment in a space provided between the head and the cap, when the capping is carried out.

Since the ejection side surface is constituted by a single plate with smooth surface, the sealing has been very good, and the sufficient sucking operation has been possible, when the sucking and recovery operation is carried out using the ink jet head. Since the surface is smoothly contoured in the wiping direction indicated by an arrow B (in a direction perpendicular to a line of the ejection outlets), the blade has not vibrate, and the residual ink does not remain so that good wiping operation does been confirmed, when the ink wiping operation is carried out. In addition, the orifice plate 400 has not been creased or damaged due to insufficient mechanical strength.

In addition, the orifice plate 400 integrally molded with the top plate 1300 with the grooves is provided with a contoured recess functioning as means adjusting the pressure at the timing of capping, the meniscus of the ink in the ejection outlet is prevented from retracting, and therefore, the printing operation after a rest can be further stabilized.

Figure 11A:
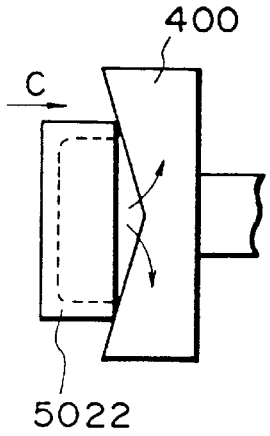
FIGS. 11(A–C) are side views of an adjusting mechanism for the inside pressure of a cap for capping the ink jet head of FIG. 10.
Figure 11B:
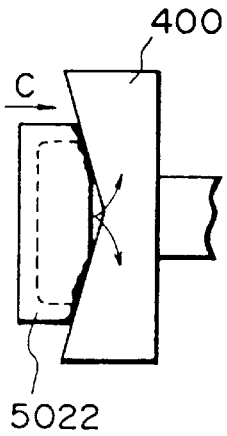
Figure 11C:
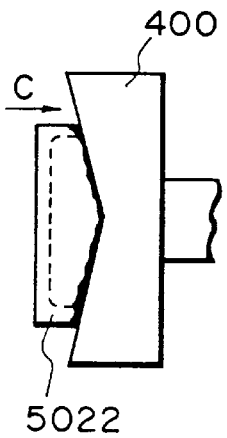

FIGS. 11A, 11B and 11C illustrate adjustment of the pressure in the cap.

In this embodiment, the cap 5022 made of rubber first contacts to the orifice plate 400. That portion of the cap 5022 which is in contact with the orifice plate 400 is only at a top and bottom end portion in the direction of the line of the orifice, whereas the central portion of the cap is not yet contacted to the orifice plate 400. With the progress of the capping action (direction C), the central portion of the cap 5022 is gradually brought into contact with the central portion of the orifice plate 400.

As shown by the arrow C, the air in the cap is pushed out by the amount of reduction of the volume in the cap by the deformation of the cap 5022. Upon completion of the capping action, as shown in Figure C, the cap 5022 is closely contacted to the orifice plate 500, with such a degree of pressure in the cap that the meniscus of the ink in the ejection outlet portion does not retract.

(Embodiment 5)

This embodiment is the same as FIG. 4 embodiment with the exception of the following. The capping operation has been performed.

Figure 12:
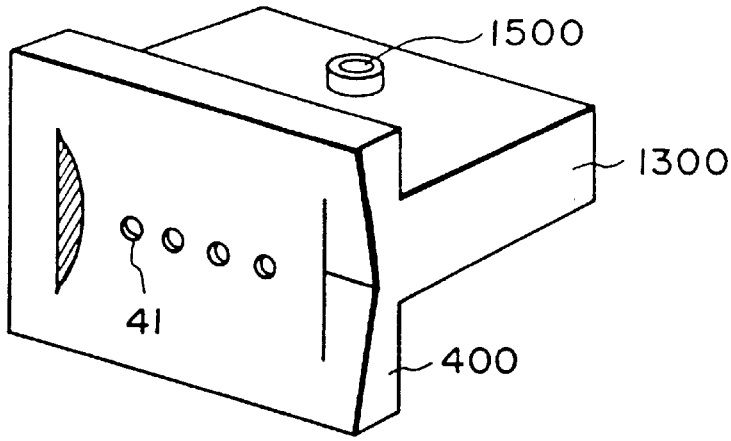
FIG. 12 is a perspective view on an ink jet head according to a further embodiment of the present invention.

FIG. 12 is a perspective view of the orifice plate 400 according to this embodiment. The recessed portion is provided only at one end of the line of the orifices. With this structure, immediately after the start of the contact with the cap, the sealing is provided at an end, but an air vent portion is provided by the recess at the other end, and therefore, the meniscus is prevented from retracting.

Figure 13:
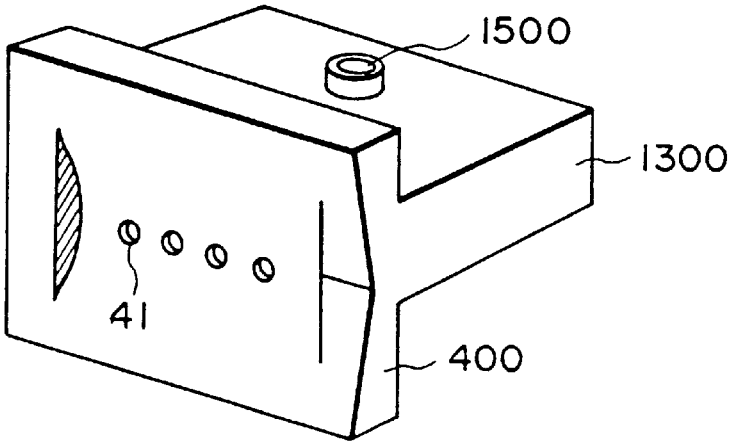
FIG. 13 is a perspective view of an ink jet head according to a further embodiment of the present invention.

In FIG. 13 modification, similarly to FIG. 10 embodiment, the recess is provided at each of the opposite ends of the orifice line. However, as contrasted to the case of FIG. 10, the ejection side surface is constituted by three differently inclined flat surfaces. Then, the foreign matter around the orifice 41 can be removed more easily, because the configuration is such that the wiping rubber blade can be easily moved with assured cleaning of the portion around the orifice. In this structure, there is no stepped portion or portions adjacent the end or ends in the direction of the line of the ejection outlets of the orifice plate 40, and therefore, the easy cleaning is assured.

The close contact between the cap and the orifice plate 400 is good enough to prevent retraction of the ink meniscus attributable to the improper ink ejection. In addition, the cleaning is made easier simultaneously.

As described in the foregoing, in the above embodiments, the top plate with the grooves and the orifice plate are molded integrally. As compared with the structure wherein a separate front plate is mounted, the close sealing by the capping can be improved, and therefore, the sucking operation can be improved. In addition, the ejection side surface is constituted by a continuous and smooth surface, and therefore, the wiping operation is possible without remaining the ink. Thus, the recovery operation is assured. The elimination of the necessity for the front plate reduces the number of parts required, so that the cost can be reduced, and the accuracy of the head is improved by the integral molding. Therefore, the reliable ink jet head and an apparatus using the same can be provided.

In addition, the thickness of the orifice plate is minimized adjacent the ejection outlets, and the formation of the ejection holes can be accomplished with high accuracy without losing the sufficient mechanical strength of the orifice plate.

Furthermore, the ejection side surface of the orifice plate is provided with a recess or recesses at the position or positions where it is contactable with the cap, so that the pressure increase at the time of the capping can be suppressed, and therefore, the retraction of the ink meniscus can be prevented at the timing of the capping action, without the necessity of additional part or parts inside or outside the cap. Therefore, improper ink ejection and various problems arising therefrom can be solved with the simple structures maintained.

(Embodiment 6)

Figure 14:
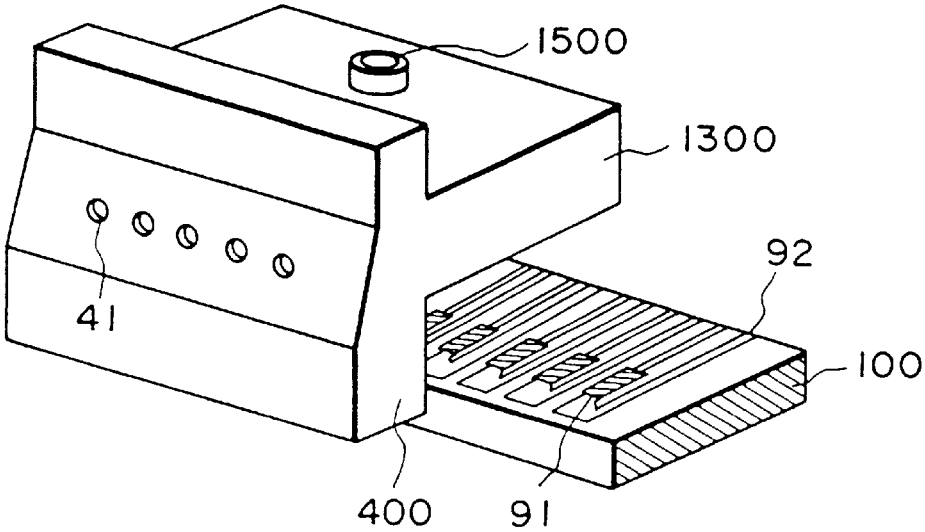
FIG. 14 is a perspective view of an ink jet head according to a further embodiment of the present invention.

FIG. 14 shows a further embodiment having the fundamental structure which is similar to that of FIG. 1. However, in this embodiment, the ejection side surface of the orifice plate is constituted by three surface components providing a step with small inclination, so as to assure the mechanical strength of the orifice plate and to assure the wiping operation. By the three surface contour, both of the cleaning and capping operations are made reliable.

Since the ejection side surface is substantially smooth, the sealing, and therefore, the sucking operation have been in good order when the sucking and recovery operation is carried out using the ink jet head of the structure. In addition, since the ejection side surface is substantially smooth in the wiping detection (perpendicular to the line of the ejection outlets), the blade has not been vibrated, and the residual ink has been sufficiently removed without remaining the residual ink at particular portion, when an ink wiping operation is performed. In addition, the orifice plate 400 has not been creased or damaged due to insufficient mechanical strength.

In addition, since the ejection side surface of the orifice plate has a step with small inclination surface, the wiping and cleaning operation has been further assured.

Figure 15:
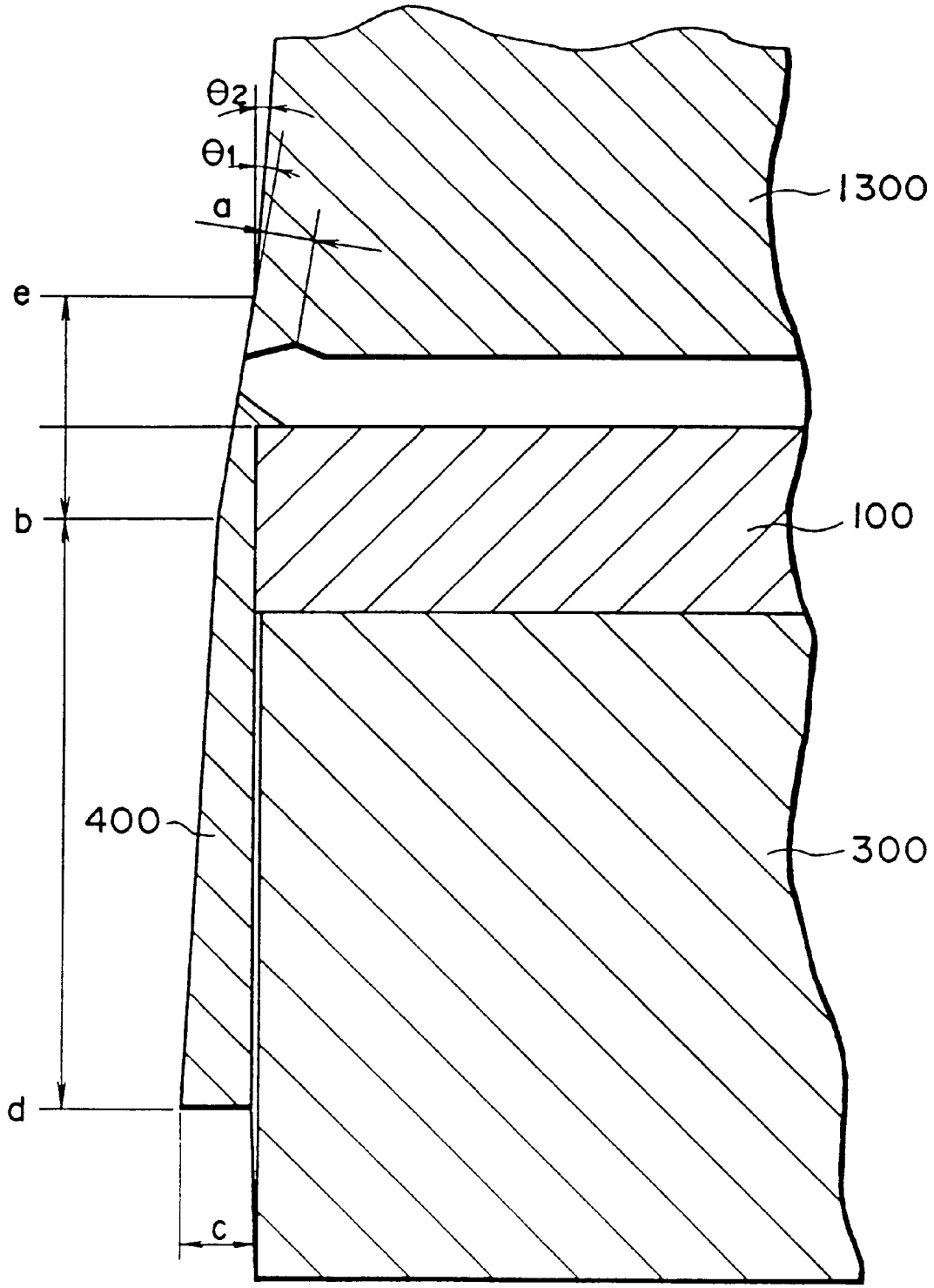
FIG. 15 is an enlarged side view of the major part of the ink jet head of FIG. 1.

Referring to FIG. 15, method of forming grooves for defining ink passages and orifices of the ink jet head according to the present invention will be described.

The top plate with the groove and with the integral orifice plate may be produced by a molding process from a resin material with a mold. The mold may be produced by machining or the like to provide an opposite pattern corresponding to the fine grooves and a recess providing the orifice plate portion.

After the material is removed from the mold, the ejection outlets are formed by applying a ultraviolet laser from a laser generating apparatus from the inside of the orifice plate 400, that is, from the groove side. By the application of the laser, the resin material is removed or evaporated to provide the aperture constituting the ejection outlet.

In this embodiment, the groove for the ink passage has a width of 40 microns, and the non-groove portion has a width of 23.5 microns. The height (depth) of the groove is 50 microns.

FIG. 15 is a sectional view. In this embodiment, the number of grooves was 90, and the number of orifices was 74, which were formed using an excimer laser. The thickness a of the orifice plate 400 (FIG. 14) have been varied in a range from 10 microns to 60 microns. The surface in which the orifices are formed is inclined, by which the thickness of the orifice plate is increased downwardly. The angle θ1 has been changed in a range from 0–20 degrees. In order to assure the good movement of the ink ejected from the ejection outlet, the recording sheet is disposed closely to the head. To permit this, the angle θ1 is limited within the above-described range, since otherwise, the orifice plate may be contacted to the recording sheet faced to the recording head.

The distances b and c are as shown in FIG. 15 and are changed. The distance c was changed from 0.1–0.3. A distance d which is a distance from the heater board 100 the bottom was changed from 1.5–3.0. The top surface component dimension of the orifice is indicated by e, and an angle of the surface above it is indicated by θ2, and they are changed from 0.08–1.0, and −5–10 degrees, respectively. Various top plates have been produced with the dimensions a, b, c, d and e and angles θ1 and θ2 varied within the above-described respective ranges, as given in the following Table 1.

TABLE 1

| No. | a (mm) | $\theta_1$(°) | b (mm) | c (mm) | d (mm) | e (mm) | $\theta_2$ (°) | Molding | Orifice formation | Wiping | Overall evaluation |
|---|---|---|---|---|---|---|---|---|---|---|---|
| 1 | 0.01 | 10 | 0.1 | 0.2 | 2.2 | 0.12 | 6 | N | — | — | — |
| 2 | 0.02 | " | " | " | " | " | " | G | G | G | G |
| 3 | 0.03 | " | " | " | " | " | " | G | G | G | G |
| 4 | 0.04 | " | " | " | " | " | " | G | G | G | G |
| 5 | 0.05 | " | " | " | " | " | " | G | G | G | G |
| 6 | 0.06 | " | " | " | " | " | " | G | N | — | N |
| 7 | 0.02 | 0 | 0.1 | 0.2 | 2.2 | 0.12 | 6 | N | — | — | N |
| 8 | " | 5 | " | " | " | " | " | G | G | G | G |
| 9 | " | 10 | " | " | " | " | " | G | G | G | G |
| 10 | " | 15 | " | " | " | " | " | G | G | G | G |
| 11 | " | 20 | " | " | " | " | " | G | G | N | N |
| 12 | 0.02 | 10 | 0.02 | 0.2 | 2.2 | 0.12 | 6 | N | — | — | N |
| 13 | " | " | 0.05 | " | " | " | " | G | G | G | G |
| 14 | " | " | 0.1 | " | " | " | " | G | G | G | G |
| 15 | " | " | 0.5 | " | " | " | " | G | G | G | G |
| 16 | " | " | 0.8 | " | " | " | " | G | G | G | G |
| 17 | " | " | 1.0 | " | " | " | " | G | G | N | N |
| 18 | 0.02 | 10 | 0.1 | 0.1 | 2.2 | 0.12 | 6 | N | — | — | N |
| 19 | " | " | " | 0.15 | " | " | " | G | G | G | G |
| 20 | " | " | " | 0.2 | " | " | " | G | G | G | G |
| 21 | " | " | " | 0.3 | " | " | " | G | G | G | G |
| 22 | 0.02 | 10 | 0.1 | 0.2 | 1.0 | 1.12 | 6 | G | G | N | N |
| 23 | " | " | " | " | 1.5 | " | " | G | G | G | G |
| 24 | " | " | " | " | 2.2 | " | " | G | G | G | G |
| 25 | " | " | " | " | 2.5 | " | " | G | G | G | G |
| 26 | " | " | " | " | 3.0 | " | " | N | — | — | N |
| 27 | 0.02 | 10 | 0.1 | 0.2 | 2.2 | 0.08 | 6 | G | G | N | N |
| 28 | " | " | " | " | " | 0.12 | " | G | G | G | G |
| 29 | " | " | " | " | " | 0.5 | " | G | G | G | G |
| 30 | " | " | " | " | " | 1.0 | " | G | G | N | N |
| 31 | 0.02 | 10 | 0.1 | 0.2 | 2.2 | 0.12 | −5 | G | G | N | N |
| 32 | " | " | " | " | " | " | 0 | G | G | G | G |
| 33 | " | " | " | " | " | " | 6 | G | G | G | G |
| 34 | " | " | " | " | " | " | 10 | G | G | N | N |

G: Good, N: No good
Nos. 1–6: θ1 = 10 degrees; θ2 = 6 degrees
Dimensions b, c, d and e = 0.1, 0.2, 2.2 and 0.12, respectively
Thickness a of orifice plate = 0.01–0.06
Nos. 7–11: Angle 0 = 6 degrees
Dimensions a, b, c, d and e = 0.02, 0.1, 0.2, 0.2 and 0.12, respectively
Angle θ1 = 0–20 degrees
Nos. 11–12: Angles θ1 and θ2 = 10 and 6 degrees, respectively
Dimensions a, c, d and e = 0.02, 0.2, 2.2 and 0.12, respectively
Dimension b = 0.02–1.0
Nos. 18–21: Angles θ and θ2 = 10 and 5 degrees, respectively
Dimensions a, b, d and e = 0.02, 0.1, 2.2 and 0.12, respectively
Dimension c = 0.1–0.3
Nos. 22–25: Angles θ1 and θ2 = 10 and 5 degrees, respectively
Dimensions a, b, c and e = 0.02, 0.1, 0.2 and 0.12, respectively
Dimension d = 1.0–3.0
Nos. 26–30: Angles θ1 and θ2 = 10 and 6 degrees, respectively
Dimensions a, b, c and d = 0.02, 0.1, 0.2 and 2.2, respectively
Dimension e = 0.08–1.0
Nos. 31–34: Angles θ = 10 degrees
Dimensions a, b, c, d and e = 0.02, 0.1, 0.2, 2.2, 0.12, respectively
Angle θ2 = −5–10 degrees Ink jet heads have been produced with the above-described various combinations of dimensions and angles, and the performance is evaluated.

The evaluation has been made with respect to (1) molding properties, (2) ease of orifice formation and (3) wiping property regarding removal of the ink deposited during the printing operation from the orifice plate.

As regards the molding property (1), the flow of the resin material will be sufficient to obtain a desired configuration, if the dimension a is too small, or if the angles θ1 or θ2 is too small, or if the dimension b is too small.

As regards the ease of orifice formation (2), the excimer laser is used in this embodiment. If the duty of the laser, that is, the dimension through which the laser beam is to penetrate, that is, the dimension a is too large, a desired orifice size will not be obtained, or the shape of the orifice will not be as desired, because of the limit of the laser power.

As regards the wiping property (3), the ink will not be sufficiently removed. Particularly, the angles θ1 and θ2 will be important from the standpoint of the stabilized movement of the blade during the cleaning operation. From the standpoint of assuring the reliability of the capping operation, the angles θ1 and θ2 will be influential. If the angles are too large, the blade will not move in a stabilized manner, or the sealing by the cap will not be sufficient.

The results of evaluation will be described regarding the tests Nos. 1–6 wherein the dimension a of the orifice plate is changed. In the test No. 1 (a=0.01), the flow of the molding resin material was not sufficient. In the tests Nos. 2–6, the molding was proper if the dimension a was not less than 0.02. In the test No. 6, the orifice formation was difficult even if the laser conditions are changed in various manner. The wiping properties were good for all tests (the phase configurations were all the same).

The results of tests Nos. 7–11 will be described wherein the angle θ2 was 6 degrees, the dimensions a, b, c, d and e are 0.02, 0.1, 0.2, 2.2 and 0.12, respectively, and wherein the angle θ1 was 0, 5, 10, 15 or 20 degrees. In test No. 7 wherein the angle θ1 was 0, the dimension b was 0.1, and the dimension a was 0.02, the resin material did not flow into the mold, and therefore, could not be evaluated. In test No. 11 wherein the angle θ1 was 20 degrees, a part of the ink could not be removed. Good results were confirmed with the heads in the tests Nos. 8–10 wherein the θ was 5, 10 or 15 degrees.

The results of tests Nos. 12–17 wherein the angles θ1 and θ2 were 10 and 6 degrees, respectively and wherein dimensions a, c, d and e were 0.02, 0.2, 2.2 and 0.12, are as follows. In the test No. 12, the resin material did not sufficiently flow into the mold, and therefore, the molding was difficult. In test No. 17, the molding of the head and the formation of the orifices were both good, but desired wiping properties were not provided even if the wiping conditions were changed in various manners. Good results have been confirmed with the head in the tests Nos. 13–16.

The results of test Nos. 18–21 wherein the dimensions a, b, c, d and e were 0.02, 0.1, 2.2 or 0.12, respectively, and wherein the angles θ1 and θ2 were 10 and 6 degrees, and wherein the dimension c was 0.1, 0.15, 0.2 or 0.3. In test No. 18 in which the dimension c was 0.1, the resin material did not sufficiently flow into the mold, and therefore, the molding was difficult. The heads used in the rest of the tests, i.e., test Nos. 19–21, the head molding, the orifice formation and the wiping properties were all good.

The results of tests Nos. 22–26 wherein dimensions a, b, c and e were 0.02, 0.2, 2.2 and 0.12, and the angles θ1 and θ2 were 10 and 6 degrees, and wherein the dimension d were 1.0, 1.5, 2.0, 2.5 or 3.0, are as follows. In test No. 22 wherein the dimension d is 1.0, it was difficult to align the cap with the head. In test No. 26 wherein the dimension d was 3.0, the resin material did not flow into the mold, and the head could not be molded. The results were good with respect to all the other heads, that is, the heads used in test Nos. 23–25.

The results of tests Nos. 27–30 wherein dimensions a, b, c and d were 0.02, 0.1, 0.2 and 2.2, respectively, and angles θ1 and θ2 were 10 and 6 degrees, and wherein the dimension e was 0.08, 0.12, 0.5 or 1.0. In test No. 27 wherein the dimension e was 0.08, the orifice was so close that the ink deposited on the orifice plate was influential to the ink ejection. In test No. 30 wherein the dimension e was 1.0, the ink could not be wiped out. The results of tests Nos. 28–29 were good.

The results of tests Nos. 31–34, wherein the dimensions a, b, c, d and e were 0.02, 0.1, 0.2, 2.2 or 0.12, and the angle θ1 was 10 degrees, and wherein the angle θ2 was −5, 0, 5 or 10 degrees. In test No. 31 wherein the angle θ2 was −5 degrees, and in test No. 34 wherein it was 10 degrees, the ink could not wiped out. The results in test Nos. 32 and 33 were good.

Accordingly, in order to properly mold the orifice plate and to obtain the desired orifices by a laser, it is particularly preferable that the dimension a is not less than 0.02, that the angle θ1 is not less than 5 degrees, that the dimension b is not less than 0.05, that the dimension c is not less than 0.15, that the dimension d is not more than 2.5, and that the dimension e is not less than 0.12. In order to obtain good wiping performance, it is preferable that the angle θ1 is not more than 15 degrees, that the angle θ2 is not less than 0, but not more than 6 degrees, that the dimension d is not more than 1.0, that the dimension d is not less than 1.0, and that the dimension e is not more than 1.0.

In summary, the ink jet head exhibiting particularly good printing performance can be provided if the following conditions are satisfied:

(1) $0.02 \leqq a \leqq 0.05$ (2) $5 \text{ degrees} \leqq \theta 1 \leqq 15 \text{ degrees}$ (3) $0.05 \leqq b \leqq 0.8$ (4) $0.15 \leqq c$ (5) $1.5 \leqq d \leqq 2.5$ (6) $0.12 \leqq e \leqq 0.5$ (7) $0 \leqq \theta 2 \leqq 6$ Therefore, the head satisfying the numerical ranges permit the head to be disposed closely to the platen, and has improved capping and cleaning performance, and in addition, the capping member can sufficiently follow the surface of the head.

Figure 16:
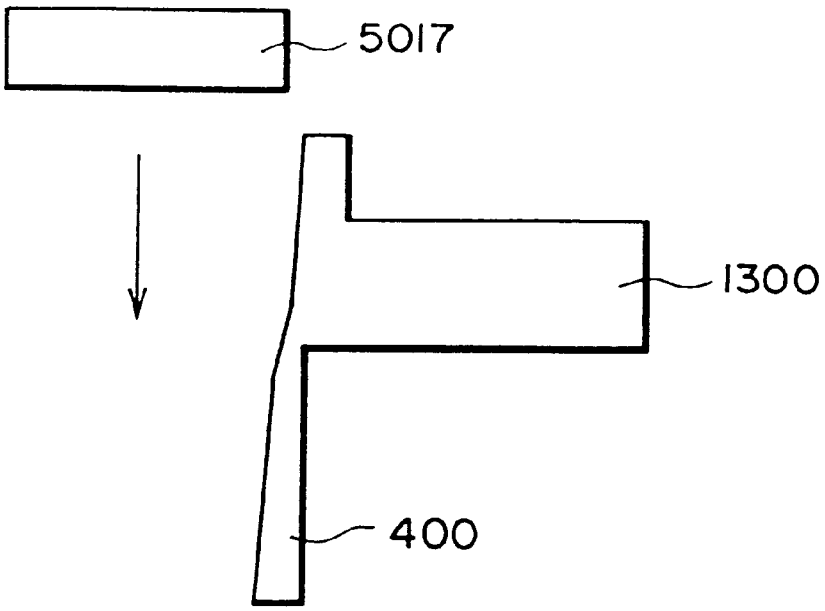
FIG. 16 is a side view of the ink jet head when it is wiped in the vertical direction.
Figure 17:
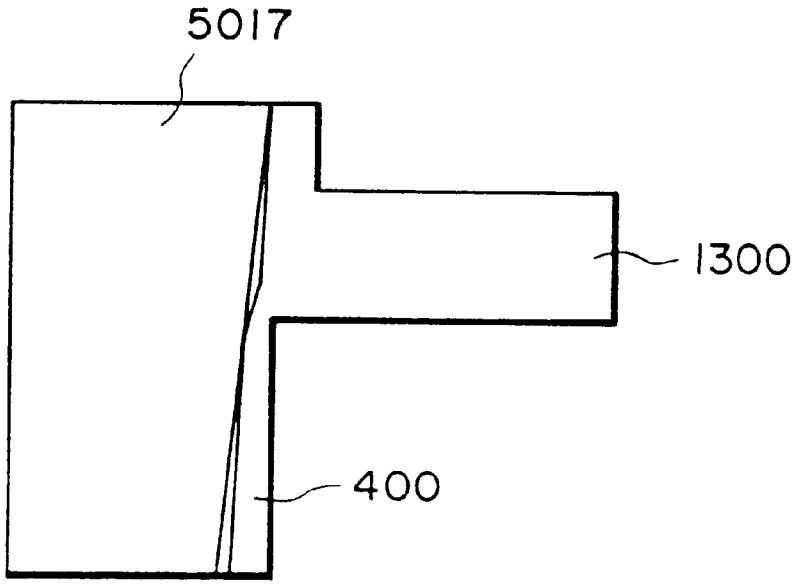
FIG. 17 is a side view of the ink jet head when it is wiped in the horizontal direction.
Figure 18:
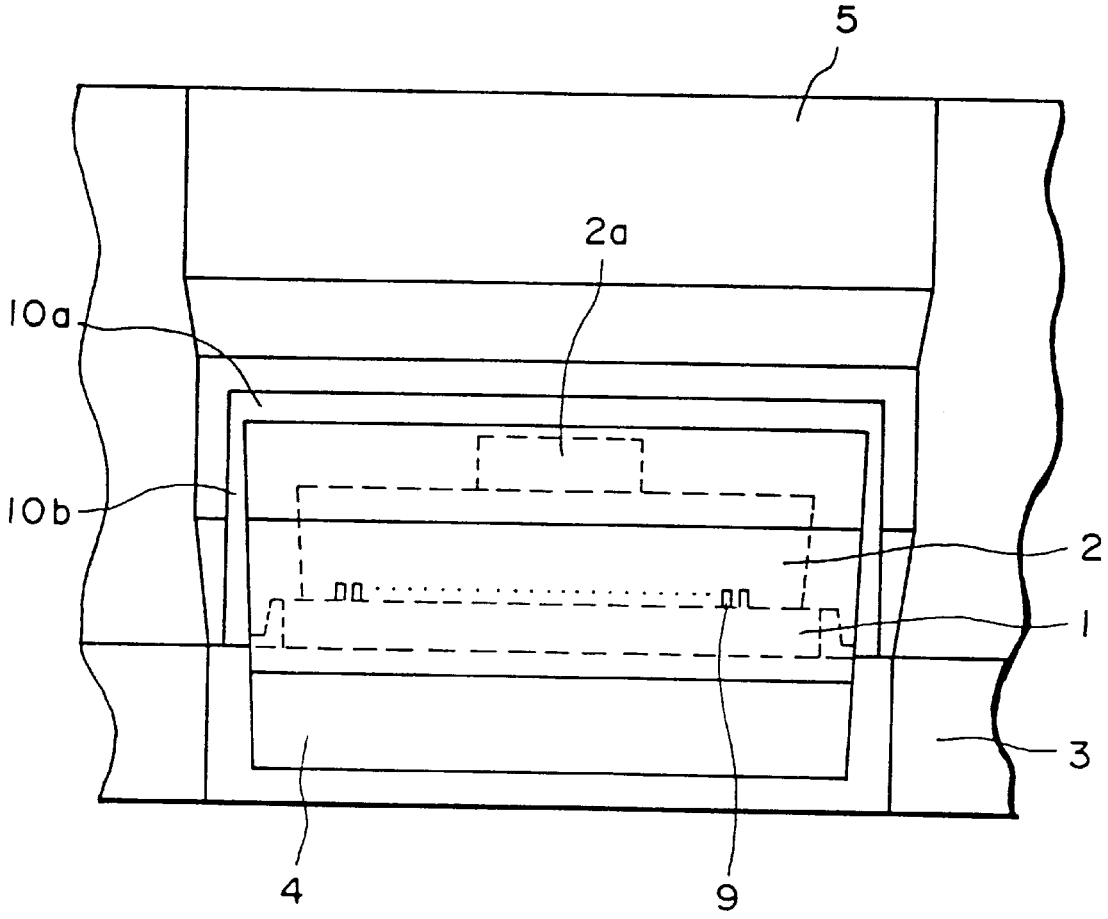
FIG. 18 is a front view of a conventional ink jet head.

Using the ink jet heads satisfying the above conditions, a good wiping operation can be performed when the head is wiped vertically, that is, in the direction perpendicular to the line of the ejection outlets, as shown in FIG. 16, and when the ink jet head is wiped laterally, that is, in the direction parallel to the line of the ejection outlets, as shown in FIG. 17. In the Figures, a wiping blade is designated by a reference numeral 5017.

As described in the foregoing, according to these embodiments, the top plate with the groove and the orifice plate are integrally molded, so that the sealing with the cap is improved so as to allow sufficient sucking operation. In addition, during the wiping operation, no residual ink remains to assure the recording operation. In addition, the cost can be reduced by the reduction of the number of the parts.

Furthermore, the ejection side surface of the orifice plate has a step with small inclination, and therefore, the cleaning operation is further assured during the wiping, without the necessity of particular part or parts inside or outside of the cap. Beyond that, the prevention of the retraction of the ink meniscus at the ejection outlet is enhanced in the capping operation. Therefore, the improper ink ejection and various problems arising therefrom can be solved without using complicated structure.

(Embodiment 7)

A further embodiment will be described wherein the junction between the orifice plate 4 and the supporting plate 3 is improved.

Figure 19A:
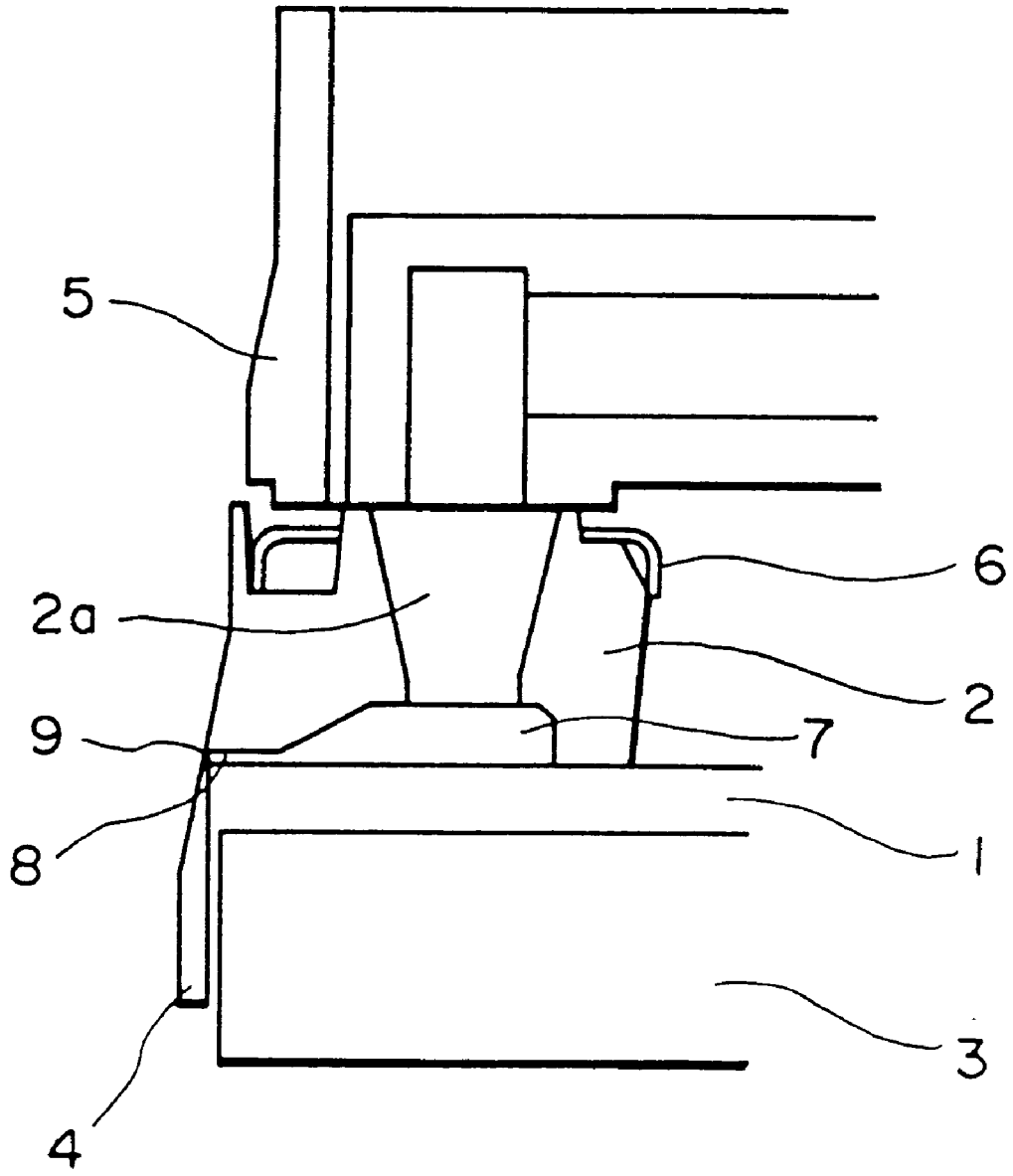
FIG. 19A is a sectional view of an ink jet head according to an embodiment of the present invention.

Referring to FIG. 19A, the ink jet head according to this embodiment comprises a base plate 1 (heater board) having ink ejection pressure generating elements and an additional base plate 2 which is coupled with the heater board 1 and which has coagulations for constituting liquid chamber 7 and liquid passages 8 for the recording liquid (ink). The base plate 2 has an integral orifice plate 4 (top plate with grooves) having ink ejection outlets 9 through which the ink is ejected and which communicates with the ink passages 8.

The heater board 1 is bonded and fixed to the supporting base plate 3 with a bonding agent. The top plate 2 is bonded to the heater board 1 so that the alignment is established between the heater portion (ink ejecting pressure generating elements) on the heater board 1 and the ink passages of the top plate 2. The orifice plate 4 of the top plate is disposed at the front side of the supporting base plate 3 in the form of an apron.

The ink is supplied from the ink supply member 5 through an ink supply port 2 a provided at the top of the top plate.

The ink supply member 5 has a projection which is penetrated through a hole formed in the supporting base plate, and is fused so that the ink supply member 5 is securely fixed on the supporting base plate.

The clearance 10*a* and 10*b* among the ink supply member 5, the heater board 1 and the top plate 2 and between the orifice plate and the front end surface of the supporting base plate, is supplied with a sealing and bonding agent.

The thickness of the orifice plate 4 constituting the ink jet head, is approximately 30–40 microns adjacent to the ejection outlets of the orifice plate. It is preferable that the thickness is larger toward the bottom of the supporting base plate 3. In this embodiment, it is 0.2 mm.

In consideration of the cost of the material and the resistance against the ink, the material of the top plate 2 with the grooves and having the orifice plate 4 is preferably thermoplastic resin such as polyimide, polyether ketone or polysulfon.

Figure 19B:
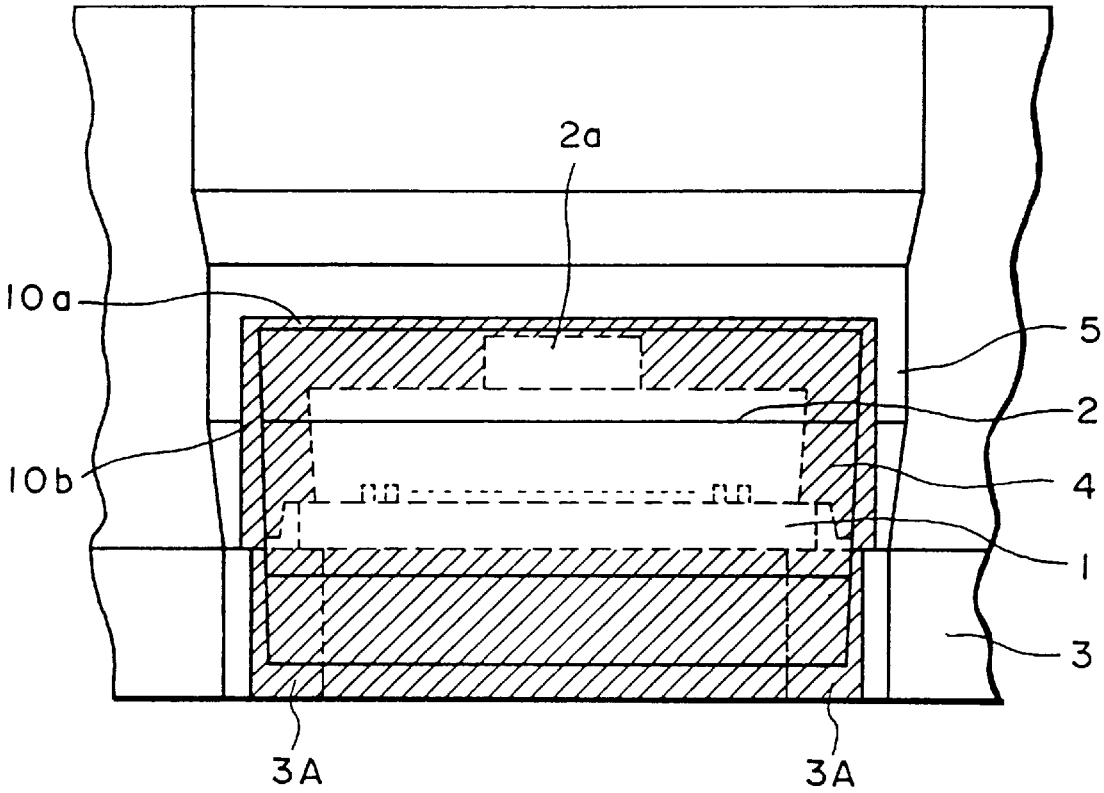
FIG. 19B is a front view of the ink jet head of FIG. 19A as seen from the ejection side.

In this embodiment, polysulfone is used since the thermal deformation at a high temperature is small. FIG. 19B shows a front view of the ink jet head. In this Figure, the hatched portion is the region in which the sealing or bonding agent is filled. The supporting base plate 3 has grooves 3A at the opposite end portions.

Figure 19C:
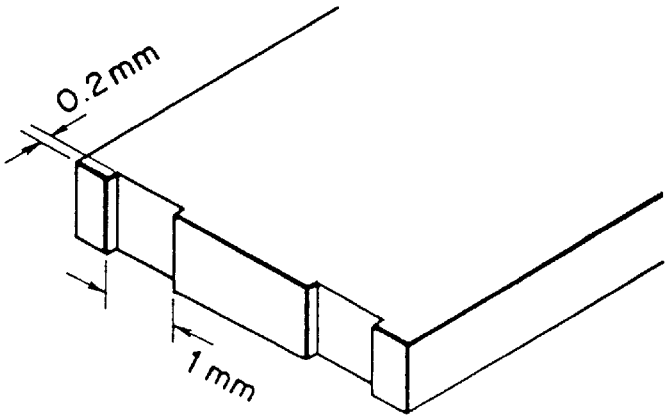
FIG. 19C is a perspective view of a supporting base plate.
Figure 20A:
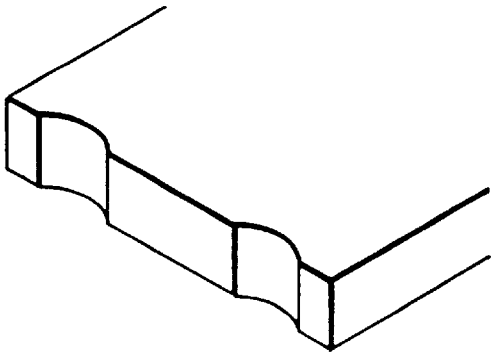
FIGS. 20A, 20B, 20C and 20D show other examples of supporting plate constituting the ink jet head.
Figure 20C:
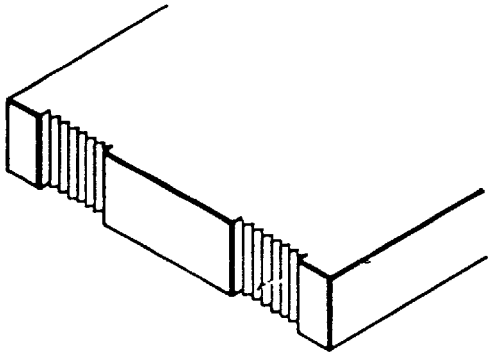
Figure 20B:
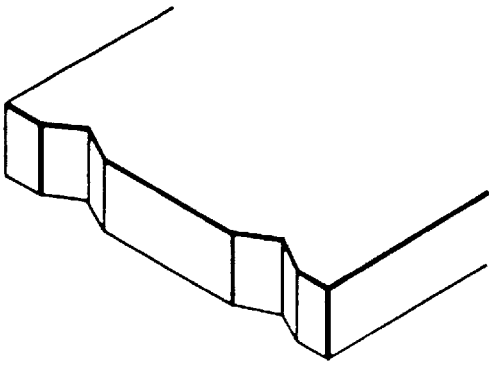
Figure 20D:
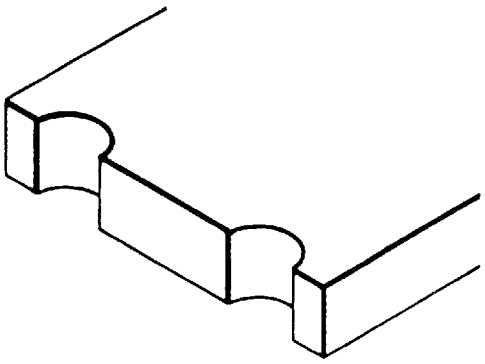

As shown in FIG. 19C, in this embodiment, the grooves 3A each have the dimension of 1 mm in the width and 0.2 mm in the depth. The dimensions are not limited to this, if the bonding agent can be sufficiently penetrated therethrough. A heater board is fixed on the supporting base plate 3 by a bonding agent, and the top plate 2 is fixed to the heater board 1 so that the heater portions of the heater board 1 aligned with the ink passages formed in the top plate 2. The top plate 2 has an integral orifice plate 4 which suspends from the front end of the supporting base plate 3 in the form of an apron.

The ink supply member 5 is fixed on the supporting base plate 3 by penetrating an unshown projection pin of the ink supply member 5 through a hole formed in the supporting base plate 3 and by fusing the penetrated portion. At this time, the clearance between the orifice plate 4 and the ink supply member 5, a uniform clearance 10*a* and 10*b* are formed. In this embodiment, the clearance 10*a* and 10*b* are both 0.1–0.2 mm.

The sealing agent is injected through a sealing agent injection port formed on the top part of the ink supply member 5. By the injection, the wire bonding for the transmission of the electric signals is sealed, and simultaneously, the clearances 10*a* and 10*b* are sealed between the orifice plate 4 and the ink supply member 5, and in addition, the agent penetrate through the grooves 3A formed in the supporting base plate 3 to completely seal the clearance between the orifice plate 4 and the front end surface of the supporting plate 3.

It should be noted that the grooves 3*a* formed in the supporting base plate 3 define a space continuing from the clearance between the orifice plate 4 and the ink supply member 5. It is not preferable that the grooves 3A are completely covered by the orifice plate 4, or that they are independent from the clearance 10*a* and 10*b*, since then the flow of the sealing agent is blocked with the result of incomplete sealing.

The sealing material in this embodiment is PSE 399 black, available from Toshiba Silicone Kabushiki Kaisha, Japan, since it is adhesive to the polysulfone and since it is possible to feel the wire bonding. The usable viscosity is 1500–3000 cp.

In order to permit mass-production, the grooves 3*a* are formed by pressing in the front surface of the supporting base plate 3.

Therefore, the cross-section of the grooves 3*a* may be semi-circular or triangular. FIGS. 20A, 20B, 20C and 20D show examples of various modifications.

However, it is desirable that when the ink jet head is assembled, a continuous space is formed between the groove 3A and the clearances 10*a* and 10*b* between the ink supply member 5, the heater board and the head chip having the top plate with the grooves.

As described in the foregoing, according to these embodiment, the clearance between the orifice plate having the top plate with the grooves and the ink supply member are made uniform within the range of 0.1–0.2 mm, and a groove continuing from the clearance is formed in the front surface of the supporting base plate, by which the sealing or bonding material can be uniformly dispensed in the clearance between the orifice plate and the ink supply member to form a meniscus, so that the sealing is strong and aesthetic. As regards the clearance between the front surface of the supporting base plate and the orifice plate, the sealing or bonding material is sufficiently supplied through the groove, so that the clearance can be completely sealed by the material. Accordingly, (1) The gap between the orifice plate and the heater board is eliminated, and therefore, the energy loss at the time of ejection can be eliminated, thus stabilizing the ejection.

(2) The air leakage can be prevented, and therefore, the recovery operation is assured.

In addition, an ink cartridge having integral head and the ink container with good performance can be provided.

Furthermore, an ink jet recording apparatus usable with such an ink cartridge can be provided.

The present invention is particularly suitably usable in a bubble jet recording head and recording apparatus developed by Canon Kabushiki Kaisha, Japan. This is because, the high density of the picture element, and the high resolution of the recording are possible.

The typical structure and the operational principle of preferably the one disclosed in U.S. Pat. Nos. 4,723,129 and 4,740,796. The principle is applicable to a so-called on-demand type recording system and a continuous type recording system particularly however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provide by the electrothermal transducer to produce film boiling on the heating portion of the recording head, whereby a bubble can be formed in the liquid (ink) corresponding to each of the driving signals. By the development and collapse of the the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a vent portion in addition to the structure of the combination of the ejection outlet, liquid passage and the electrothermal transducer as disclosed in the above-mentioned patents. In addition, the present invention is applicable to the structure disclosed in Japanese Laid-Open Patent Application Publication No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plural recording head combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating element and means for preliminary ejection not for the recording operation, which can stabilize the recording operation.

As regards the kinds of the recording head mountable, it may be a single corresponding to a single color ink, or may be plural corresponding to the plurality of ink materials having different recording color or density. The present invention is effectively applicable to an apparatus having at least one of a monochromatic mode mainly with black and a multi-color with different color ink materials and a full-color mode by the mixture of the colors which may be an integrally formed recording unit or a combination of plural recording heads.

Furthermore, in the foregoing embodiment, the ink has been liquid. It may be, however, an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material on through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. An ink jet head, comprising:

a first substrate having a plurality of ink ejection pressure generating elements for ejecting an ink through a plurality of corresponding ink ejection outlets;

a second substrate integrally having an orifice plate and a grooved portion, said orifice plate having the ink ejection outlets, and said grooved portion cooperating with and being positioned relative to said first substrate so as to define a plurality of ink passages in fluid communication with the ink ejection outlets;

a supporting member for supporting said first substrate, said supporting member having an ink ejection side surface having a groove, wherein the ink ejection side surface of said supporting member abuts said orifice plate, and a sealant enters through said groove in said supporting member between said orifice plate and ink ejection side surface.

2. An ink jet head according to claim 1, wherein said ink ejection pressure generating elements are electrothermal transducers.

3. An ink jet head according to claim 1, further comprising an integral ink container for supplying the ink to said ink passages.

4. An ink jet recording apparatus comprising:

an ink jet cartridge having an integral ink jet head comprising;

an ink jet head, comprising:

a first substrate having a plurality of ink ejection pressure generating elements for ejecting an ink through a plurality of corresponding ink ejection outlets;

a second substrate integrally having an orifice plate and a grooved portion, said orifice plate having the ink ejection outlets, and said grooved portion cooperating with and being positioned relative to said first substrate so as to define a plurality of ink passages in fluid communication with the ink ejection outlets;

a supporting member for supporting said first substrate, said supporting member having an ink ejection side surface having a groove, wherein the ink ejection side surface of said supporting member abuts said orifice plate, and a sealant enters through said groove in said supporting member between said orifice plate and ink ejection side surface;

an ink container containing an ink supplied to said ink jet head;

supply means for supplying the ink from said ink container to said ink jet head; and a carriage for carrying said cartridge.

* * * * *

UNITED STATES PATENT AND TRADEMARK OFFICE

CERTIFICATE OF CORRECTION

PATENT NO. : 6,059,400

DATED : May 9, 2000

INVENTOR(S) : MAKIKO KIMURA, ET AL

It is certified that error appears in the above-identified patent and that said Letters Patent is hereby corrected as shown below:

ON THE TITLE PAGE:

[56] References Cited, under FOREIGN PATENT DOCUMENTS

"5-45163" should read --59-45163--.

COLUMN 1:

Line 15, "apparatus;" should read --apparatus,--;
Line 35, "head," should read --head--;
Line 40, "bounced" should read --bounce--; and
Line 52, "the residual" should read --residual--; and
"orifice" should read --the orifice--.

COLUMN 2:

Line 35, "sufficient" should read --a sufficient--; and
Line 36, "case." should read --cases.--.

COLUMN 3:

Line 19, "FIGS. 11(A-C)" should read --FIGS. 11A to 11C--;
Line 44, "supporting" should read --a supporting--; and
Line 49, "heat IJH," should read --head IJH,--.

COLUMN 5:

Line 55, "to" should be deleted.

UNITED STATES PATENT AND TRADEMARK OFFICE

CERTIFICATE OF CORRECTION

PATENT NO. : 6,059,400

DATED : May 9, 2000

INVENTOR(S) : MAKIKO KIMURA, ET AL

It is certified that error appears in the above-identified patent and that said Letters Patent is hereby corrected as shown below:

COLUMN 6:

Line 4, "water repellent" should read --water-repellent--.

COLUMN 7:

Line 45, "take" should read --takes--.

COLUMN 8:

Line 20, "inconventional device," should read --in conventional devices,--;
Line 31, "is" should read --are--; and
Line 36, "combined" should read --combined with--.

COLUMN 10:

Line 12, "clutch" should read --a clutch--;
Line 43, "reaches" should read --reach--; and
Line 58, "form" should read --from--.

COLUMN 11:

Line 7, "smooth" should be deleted;
Line 10, "marginaly" should read --marginal--; and
Line 50, "embodiment 3." should read --Embodiment 3.--.

COLUMN 12:

Line 22, "FIG. 10" should read --FIG. 10,--;

UNITED STATES PATENT AND TRADEMARK OFFICE

CERTIFICATE OF CORRECTION

PATENT NO. : 6,059,400

DATED : May 9, 2000

INVENTOR(S) : MAKIKO KIMURA, ET AL

It is certified that error appears in the above-identified patent and that said Letters Patent is hereby corrected as shown below:

COLUMN 12: (cont.)

Line 34, "has" should read --does--;
Line 36, "does" should read --has--; and
Line 60, "Figure C," should read --FIG. 11C,--.

COLUMN 14:

Line 13, "method" should read --a method--;
Line 26, "a" (first occurrence) should read --an--;
Line 43, "have" should read --has--;
Line 53, "100 the" should read --100 to the--; and
Line 61, "O2," should read --Θ2,--.

COLUMN 15:

Line 37, "Angle O" should read --Angle Θ--.

COLUMN 17:

Line 2, "manner." should read --manners.--; and
Line 57, "wiped" should read --be wiped--.

COLUMN 18:

Line 67, "port 2 a" should read --port 2a--.

COLUMN 19:

Line 13, "and the" should read --and its--;

UNITED STATES PATENT AND TRADEMARK OFFICE

CERTIFICATE OF CORRECTION

PATENT NO. : 6,059,400

DATED : May 9, 2000

INVENTOR(S) : MAKIKO KIMURA, ET AL

It is certified that error appears in the above-identified patent and that said Letters Patent is hereby corrected as shown below:

COLUMN 19: (cont.)

Line 30, "aligned" should read --are aligned--;
Line 48, "penetrate" should read --penetrates--;
Line 52, "grooves 3a" should read --grooves 3A--; and
Line 65, "grooves 3a" should read --grooves 3A--.

COLUMN 20:

Line 1, "grooves 3a" should read --grooves 3A--;
Line 10, "embodiment," should read --embodiments,--;
Line 37, "of" should read --are--;
Line 41, "system" should read --system;--;
Line 47, "provide" should read --provided--; and
Line 51, "the the" should read --the--.

UNITED STATES PATENT AND TRADEMARK OFFICE

CERTIFICATE OF CORRECTION

PATENT NO. : 6,059,400

DATED : May 9, 2000

INVENTOR(S) : MAKIKO KIMURA, ET AL

It is certified that error appears in the above-identified patent and that said Letters Patent is hereby corrected as shown below:

COLUMN 22:

Line 40, "comprising;" should read --comprising:--.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,059,400
APPLICATION NO. : 08/949529
DATED : May 9, 2000
INVENTOR(S) : Makiko Kimura et al.

It is certified that error appears in the above-identified patent and that said Letters Patent is hereby corrected as shown below:

ON THE TITLE PAGE:

[56] References Cited, under FOREIGN PATENT DOCUMENTS
"5–45163" should read --59–45163--.

COLUMN 1:

Line 15, "apparatus;" should read --apparatus,--;
Line 35, "head," should read --head--;
Line 40, "bounced" should read --bounce--; and
Line 52, "the residual" should read --residual--; and
"orifice" should read --the orifice--.

COLUMN 2:

Line 35, "sufficient" should read --a sufficient--; and
Line 36, "case." should read --cases.--.

COLUMN 3:

Line 19, "FIGS. 11(A–C)" should read --FIGS. 11A to 11C--;
Line 44, "supporting" should read --a supporting--; and
Line 49, "heat IJH," should read --head IJH,--.

COLUMN 5:

Line 55, "to" should be deleted.

COLUMN 6:

Line 4, "water repellent" should read --water-repellent--.

COLUMN 7:

Line 45, "take" should read --takes--.

UNITED STATES PATENT AND TRADEMARK OFFICE

CERTIFICATE OF CORRECTION

PATENT NO. : 6,059,400
APPLICATION NO. : 08/949529
DATED : May 9, 2000
INVENTOR(S) : Makiko Kimura et al.

It is certified that error appears in the above-identified patent and that said Letters Patent is hereby corrected as shown below:

COLUMN 8:

Line 20, “inconventional device,” should read
--in conventional devices,--;
Line 31, “is” should read --are--; and
Line 36, “combined” should read --combined with--.

COLUMN 10:

Line 12, “clutch” should read --a clutch--;
Line 43, “reaches” should read --reach--; and
Line 58, “form” should read --from--.

COLUMN 11:

Line 7, “smooth” should be deleted;
Line 10, “marginaly” should read --marginal--; and
Line 50, “embodiment 3.” should read --Embodiment 3.--.

COLUMN 12:

Line 22, “FIG. 10” should read --FIG. 10,--;
Line 34, “has” should read --does--;
Line 36, “does” should read --has--; and
Line 60, “Figure C,” should read --FIG. 11C,--.

COLUMN 14:

Line 13, “method” should read --a method--;
Line 26, “a” (first occurrence) should read --an--;
Line 43, “have” should read --has--;
Line 53, “100 the” should read --100 to the--; and
Line 61, “02,” should read --Θ2,--.

COLUMN 15:

Line 37, “Angle O” should read --Angle Θ--.

COLUMN 17:

Line 2, “manner.” should read --manners.--; and
Line 57, “wiped” should read --be wiped--.

UNITED STATES PATENT AND TRADEMARK OFFICE

CERTIFICATE OF CORRECTION

PATENT NO. : 6,059,400
APPLICATION NO. : 08/949529
DATED : May 9, 2000
INVENTOR(S) : Makiko Kimura et al.

It is certified that error appears in the above-identified patent and that said Letters Patent is hereby corrected as shown below:

COLUMN 18:

Line 67, “port 2 a” should read --port 2a--.

COLUMN 19:

Line 13, “and the” should read --and its--;
Line 30, “aligned” should read --are aligned--;
Line 48, “penetrate” should read --penetrates--;
Line 52, “grooves 3a” should read --grooves 3A--; and
Line 65, “grooves 3a” should read --grooves 3A--.

COLUMN 20:

Line 1, “grooves 3a” should read --grooves 3A--;
Line 10, “embodiment” should read --embodiments,--;
Line 37, “of” should read --are--;
Line 41, “system” should read --system;--;
Line 47, “provide” should read --provided--; and
Line 51, “the the” should read --the--.

COLUMN 22:

Line 40, “comprising;” should read --comprising:--.

Signed and Sealed this

Twenty-seventh Day of November, 2007

JON W. DUDAS
*Director of the United States Patent and Trademark Office*